US007121062B2

(12) United States Patent
Till

(10) Patent No.: US 7,121,062 B2
(45) Date of Patent: Oct. 17, 2006

(54) BEVERAGE BOTTLING PLANT FOR FILLING BOTTLES WITH A LIQUID BEVERAGE FILLING MATERIAL, HAVING A CONTAINER HANDLING MACHINE WITH INTERCHANGEABLE RECEPTACLES FOR THE CONTAINER MOUTH

(75) Inventor: Volker Till, Hofheim/Taunus (DE)

(73) Assignee: KHS Maschinen- und Anlagenbau AG, Dortmund (DE)

( * ) Notice: Subject to any disclaimer, the term of this patent is extended or adjusted under 35 U.S.C. 154(b) by 0 days.

(21) Appl. No.: 10/939,170

(22) Filed: Sep. 10, 2004

(65) Prior Publication Data

US 2005/0126118 A1 Jun. 16, 2005

(30) Foreign Application Priority Data

Sep. 13, 2003 (DE) ..... 103 42 415

(51) Int. Cl.
*B65B 31/02* (2006.01)
*B67C 3/24* (2006.01)

(52) U.S. Cl. ..... 53/167; 53/201; 53/282

(58) Field of Classification Search ..... 53/167, 53/201, 282
See application file for complete search history.

(56) References Cited

U.S. PATENT DOCUMENTS 3,356,510 A * 12/1967 Barnby ..... 53/167
3,833,031 A * 9/1974 Fechheimer ..... 141/145
3,964,234 A * 6/1976 Hurst ..... 53/334
5,778,633 A * 7/1998 Sweeny ..... 53/300
6,082,418 A * 7/2000 Naecker et al. ..... 141/145
6,263,940 B1 * 7/2001 Menayan ..... 53/585
2005/0045244 A1 * 3/2005 Hartness et al. ..... 141/144

FOREIGN PATENT DOCUMENTS

EP 0405402 A2 * 1/1991
WO WO 03/024860 A1 * 3/2003

* cited by examiner

*Primary Examiner*—Stephen F. Gerrity
(74) *Attorney, Agent, or Firm*—Nils H. Ljungman & Associates

(57) ABSTRACT

A container handling machine for containers, such as bottles, with a carousel that rotates around a vertical axis, with handling stations located at appropriate intervals for the handling of the containers, whereby the handling stations are located in a space that is essentially enclosed and is pressurized with a controlled atmosphere and having rotating portions of the space and non-rotating portions that are stationary with respect to the rotating portions, with receptacles (12) for holding the containers corresponding to each handling station, whereby these receptacles (12) are interchangeable.

20 Claims, 15 Drawing Sheets

FIG. 7
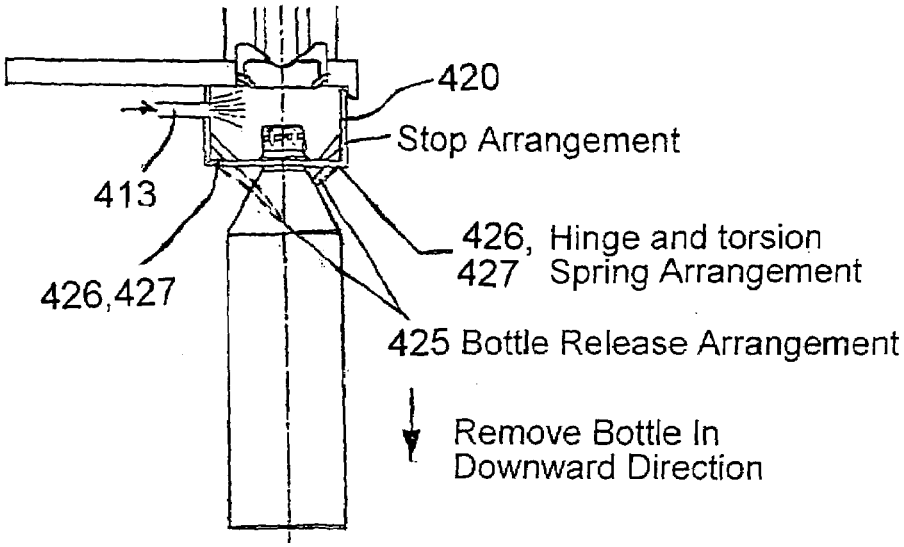
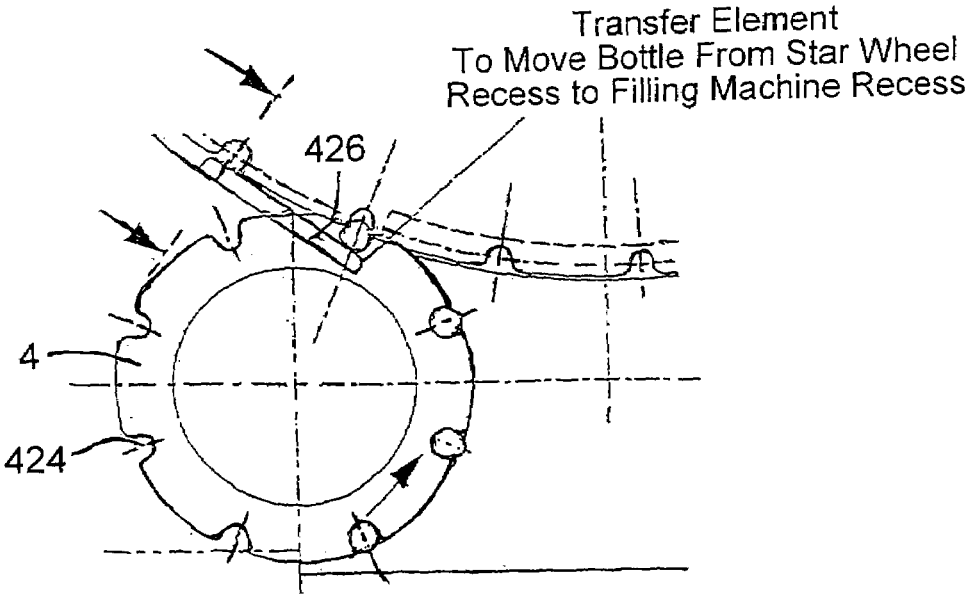
FIG. 8

BEVERAGE BOTTLING PLANT FOR FILLING BOTTLES WITH A LIQUID BEVERAGE FILLING MATERIAL, HAVING A CONTAINER HANDLING MACHINE WITH INTERCHANGEABLE RECEPTACLES FOR THE CONTAINER MOUTH

BACKGROUND

1. Technical Field

This application relates to a beverage bottling plant for filling bottles with a liquid beverage filling material, a beverage container filling machine, and a beverage container closing machine.

2. Background Information

A beverage bottling plant for filling bottles with a liquid beverage filling material can possibly comprise a beverage filling machine with a plurality of beverage filling positions, each beverage filling position having a beverage filling device for filling bottles with liquid beverage filling material. The filling devices may have an apparatus designed to introduce a predetermined volume of liquid beverage filling material into the interior of bottles to a substantially predetermined level of liquid beverage filling material. The apparatus designed to introduce a predetermined flow of liquid beverage filling material further comprises an apparatus that is designed to terminate the filling of the beverage bottles upon the liquid beverage filling material reaching the predetermined level in bottles. There may also be provided a conveyer arrangement that is designed to move bottles, for example, from an inspecting machine to the filling machine. Upon filling, a closing station closes the filled bottles. There may further be provided a conveyer arrangement configured to transfer filled bottles from the filling machine to the closing station. Bottles may be labeled in a labeling station, the labeling station having a conveyer arrangement to receive bottles and to output bottles. The closing station and the labeling station may be connected by a corresponding conveyer arrangement.

Container handling machines include, for example, filling machines, capping machines, rinsers etc. In higher-capacity bottling plants, these machines employ a rotating construction, whereby the handling spaces that hold the containers are located on the periphery of a carousel and carry along the containers in a circulating movement during handling operations.

Given the increased requirements relating to the quality of the beverages to be bottled and their shelf life, a construction is necessary in which the handling spaces are in an enclosed space that can be filled with a controlled atmosphere. This space can be filled with an inert gas atmosphere, e.g. $CO_2$ with a sterilizing atmosphere of $H_2O_2$ for example, to thereby ensure a low-oxygen and aseptic processing of the beverages, which is of priority importance for the quality of the beverages being bottled, in particular when the cold bottling method which is preferred by many users is employed. A variety of such handling machines are used in the beverage industry.

DE-PS 696 569 describes a construction of this type in which a filling machine is located in a closed housing. The space thereby formed is determined by the overall size of the machine and encloses a considerable volume. DE 199 11 517 A1 describes a rotating filling machine which is located in its entirety inside a housing that encloses it with very little clearance on all sides. The size of the housing is determined by the size of the machine and is thereby likewise of considerable volume. DE 198 35 369 C1 shows a realization in which the container handling machines extend in a sealed manner with their handling spaces located on the bottom downward into a space in which there is a controlled atmosphere. This space is designed so that it is accessible from underneath the machine.

An additional solution is disclosed in DE 197 31 796. In this industrial configuration, the filling and capping machines are located in a clean room, the volume of which is so small that there is only free space to perform the necessary service and maintenance work on the filling and capping machine. The purpose of reducing the volume of the clean space is to reduce the operating costs of the plant. An immersion sterilizer is also located directly adjacent to the clean space. The purpose of this measure, in comparison to EP 0120 789, is to eliminate the second rinser and the associated acquisition and operating costs. Overall, one disadvantage of this solution is that here, too, a clean space is provided that encloses both the filling and capping machine in their entirety, which means that the clean space will be very large and will entail high construction and operating costs. The greatest possible reduction in the volume of the clean space, which is the object of this realization of the prior art, also has major disadvantages in terms of restricting access for any maintenance work that has to be performed.

Consequently, the large volume of the space that has to be filled with a controlled atmosphere is a disadvantage in the constructions of the prior art. This space has to be opened whenever operation is disrupted. In that case, the space is filled with normal ambient air and becomes correspondingly contaminated. The subsequent cleaning of the space before operation can be resumed is determined essentially by its surface area and the total volume. With the large-volume spaces of the prior art, even minor operational disruptions or required retooling operations can interrupt production for long periods, because every time the space that is filled with a controlled atmosphere must be opened, it has to be cleaned, a process that generally takes several hours.

Finally, DE 101 45 803 A1 and DE 297 13 155 U1 show that the enclosed space is realized in the form of a ring-shaped tunnel that encircles the filling machine carousel and the ring-shaped boiler on one hand, and is enclosed by the stationary surfaces on the other hand, whereby the stationary and carousel surfaces that form the tunnel are sealed from and/or to each other by means of concentric seals or gaskets. These configurations of the prior art result in significant reductions in the size of the clean space or clean room.

A further improvement is proposed by another application by the same applicant which is Case No. DE 103 26 618.6.

In the context of this application, methods are taught that further limit the size of the handling space.

A handling machine as described in DE 103 26 618.6 has a clean space that consists of a three-dimensional portion that rotates with the filling machine and a stationary, non-rotating three-dimensional portion, whereby only the mouth portions of the beverage containers are admitted into the clean space.

A partition wall of the clean space that rotates with the rotating carousel thereby contains the receptacles and/or supports and centering devices for the mouth portions or parts of the containers, such as neck rings, for example.

These receptacles, supports and/or centering devices are located in the bottom, approximately horizontal rotating boundary wall of the clean space.

Because an increasingly essential requirement of beverage bottling operations is that they must be able to handle, i.e. to fill, different container sizes with a single container handing machine, on a device like the one described in DE 103 26 6187 it is necessary to realize the receptacles and/or supports so that they can be adapted to the largest occurring diameter of the container neck.

With this method, during the handling of containers with relatively small container neck diameters, there are relatively large openings through which the controlled atmosphere can escape, which results in undesirably high costs.

With an increased demand for quality of the beverage to be filled into containers and its stability of durability, there is at hand a type of arrangement in which the handling positions are disposed in a closed space that is supplied with a special atmosphere. Such a space can be supplied with an inert atmosphere, for example, carbon dioxide, with a sterilizing atmosphere, or with hydrogen peroxide and thus can ensure a treatment of the beverage that is low in oxygen and low in germs, this being of paramount importance for the filling quality of the beverage. Such handling machines are known in many varieties in the beverage industry.

German Patent No. DE-PS 696,569 shows an arrangement in which a filling machine is disposed in a closed housing. The space that is provided in this manner is determined by the full size of the machine and has a substantial volume. German Patent Publication No. DE-OS 199 11 517 A1 shows a rotating filling machine that is fully disposed in a tightly surrounding housing that has a size that is determined by the size of the machine and, accordingly, the housing is also of substantial volume. German Patent No. DE-PS 198 35 369 C1 shows an embodiment in which the lower handling positions of container handling machines extend in sealed manner from above into a space that is supplied with a special atmosphere. This space is equipped so as to be accessed from below.

A further solution is disclosed in German Patent Publication No. DE-OS 197 31 796. The technical embodiment of this reference comprises a filling machine and a closing machine that are both disposed in a clean space or room that has a volume that is dimensioned so as to be so tight such that there is only space for maintenance at the filling machine and at the closing machine. By way of the reduction of the volume of the clean space, a lowering of the operating expense of the arrangement is to be attained. In addition, an immersion bath sterilizer is directly disposed at the clean space. This measure is to achieve, in contrast with European Patent No. EP 0120 789, to make the second rinser superfluous and to obviate associated operating and capital expenditures. This solution comprises overall the drawback that also in this embodiment there is suggested a clean space that fully envelops the filling machine, as well as the closing machine, and this arrangement requires a large amount of space and high construction and operating expenses. The desired extensive reduction in size of the constructive volume of the clean space that is sought in this teaching entails marked disadvantages, due to the diminished accessibility when maintenance is to be carried out.

The substantial volume of the space that is supplied with a special atmosphere is, accordingly, of disadvantage in the designs of the prior art. In the event of disruptions of operations, the space needs to be opened. It is then filled with normal ambient air and is correspondingly accessible to germs. The subsequent cleaning of the space prior to resumption of operations is largely determined by the surfaces and the overall volume of the space. In the case of the known large clean rooms, accordingly, the interruptions of operations, that are necessary due to disruptions of operations, or required relocation of machines, as well as the unavoidable cleaning of machines, last for hours.

From German Patent Publication No. DE-OS 101 45 803 A1 (corresponding to International Patent Publication No. WO 03/024860 A1, published on Mar. 27, 2003) and German Petty Patent No. DE-GM 297 13 155 U1, (corresponding to U.S. Pat. No. 6,026,867 issued to Karl on Feb. 22, 2000), it is finally known that the closed space is configured as an annular tunnel structure that moves about/or surrounds the carousel of the filling machine and the annular boiler, on the one hand, and by the stationary surfaces, on the other hand, whereby the carousel surfaces and the stationary surfaces are disposed in sealing manner atop one another or, respectively, with respect to one another by way of concentric seal elements. These known configurations already substantially reduce the required clean space.

OBJECT OR OBJECTS

One possible object is to improve the receptacles and/or supports to reduce the operating costs of a device of the type claimed and described herein below.

The present application teaches that the receptacles for the container mouth are interchangeable.

In an additional independent development, the receptacles are not interchangeable and can be adapted to different container dimensions by interchangeable inserts.

The above-discussed embodiments of the present invention will be described further hereinbelow. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The embodiments are explained in greater detail below on the basis of the exemplary embodiments illustrated in the accompanying drawings, in which:

FIG. 7 is a view similar to FIG. 4 that illustrates a bottle unload arrangement for special cases that are caused by disruptions;

FIG. 8 illustrates a transfer arrangement for transferring bottles from the input star conveyer to the filling machine.

DESCRIPTION OF EMBODIMENT OR EMBODIMENTS

Developments, advantages and potential applications of the embodiments are described below with reference to the exemplary embodiments illustrated in the accompanying drawings. All the features described and/or illustrated are the object of the present application, individually or in any possible combination, regardless of their placement in the claims or the references to other claims. The content of the claims is also an integral part of the description and is hereby incorporated by reference.

Figure 1:
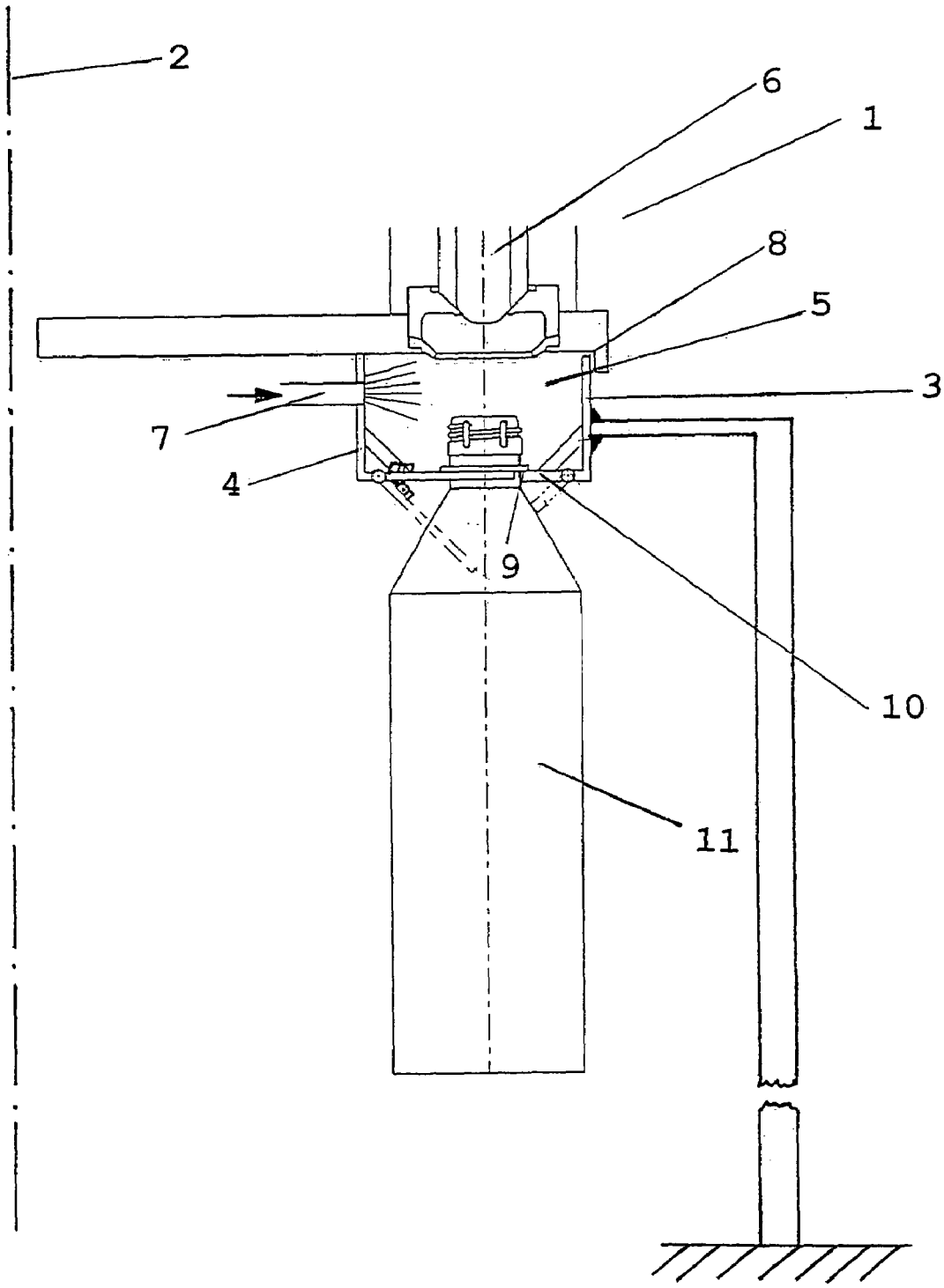
FIG. 1 is a simplified illustration of a bottle handling machine with a realization of the receptacles for the container mouth as claimed by the present application.
Figure 1A:
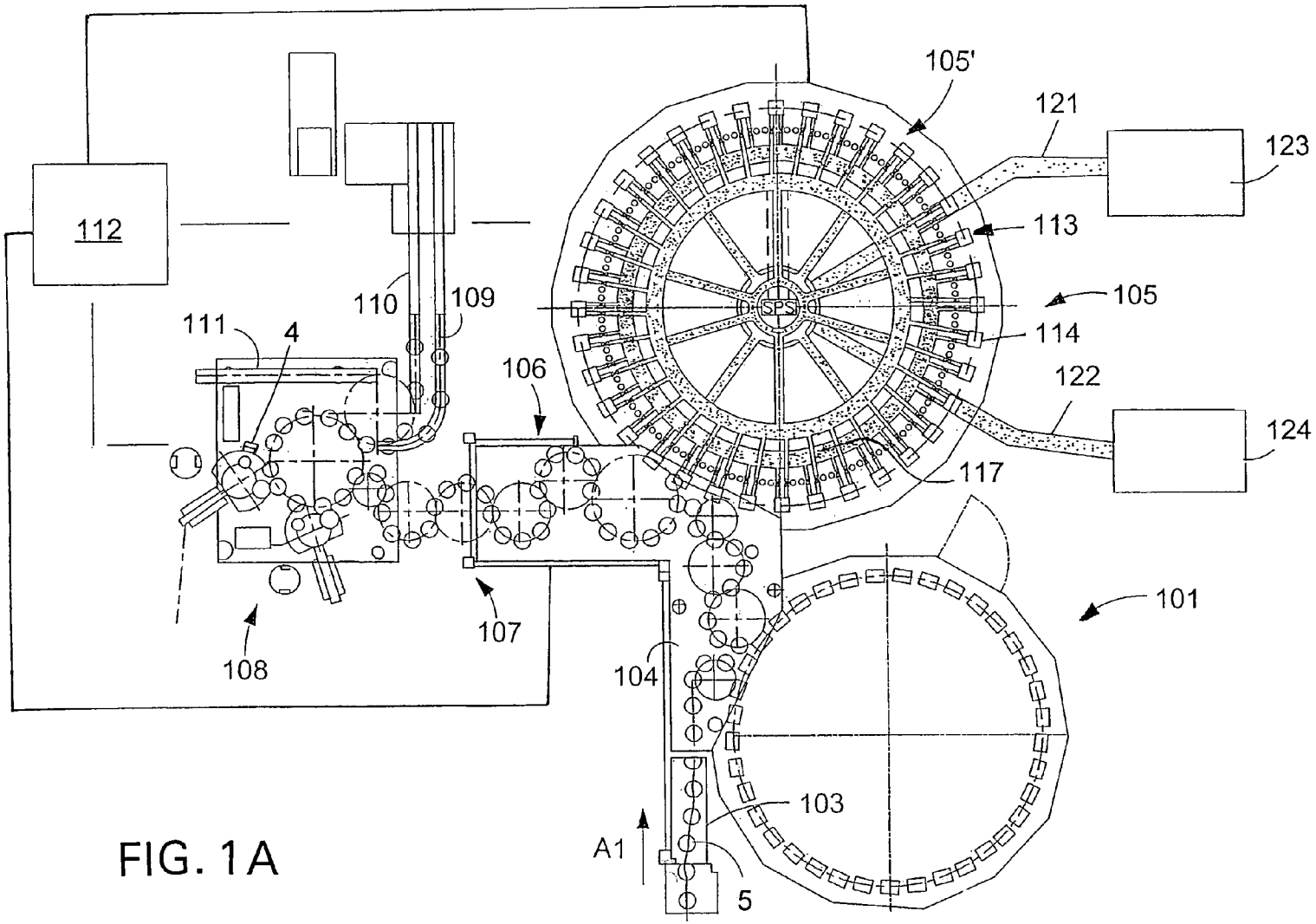
FIG. 1A is a schematic illustration of a container filling plant in accordance with one possible embodiment.

FIG. 1A shows schematically the main components of one embodiment example of a system for filling containers, specifically, an embodiment of a beverage bottling plant 100 for filling bottles B with liquid beverage filling material, in accordance with one embodiment, or in which system or plant could possibly be utilized at least one aspect, or several an aspects, of the embodiments disclosed herein.

FIG. 1A shows a rinsing arrangement or rinsing station 101, to which the containers, namely bottles B, are fed in the direction of travel as is indicated by the arrow A, by means of a conveyer line or conveyer arrangement to feed bottles to rinsing arrangement 103, and downstream of rinsing arrangement or rinsing station 101, in the direction of travel as is indicated by the arrow A, the rinsed bottles B are transported to a beverage filling machine 105 by means of a conveyer line or conveyer arrangement to pass bottles to filling machine 104 that is formed, for example, by a starwheel conveyer or a plurality of starwheels of a conveyer arrangement. The conveyer arrangement to pass bottles to filling machine 104 may possibly comprise a starwheel conveying structure 104*a* that introduces bottles B to the filling machine 105.

Downstream of the filling machine 105, in the direction of travel of the bottles B, there can preferably be a closing arrangement or closing station 106 which closes the bottles B.

The closing arrangement or closing station 106 can, for example, be connected directly to a labeling arrangement or labeling station 108 having at least one labeling unit, device, or module for first product 108*a*, each unit having a head, such as, for example, by means of a conveyer arrangement to pass bottles to labeling arrangement 107 that may be formed, for example, by a plurality of starwheels of a conveyer arrangement.

In the illustrated embodiment, the labeling arrangement or labeling station 108 having at least one labeling unit, device, or module for first product 108*a*, each unit having a head has, for example, three outputs, namely one output formed by a conveyer arrangement to convey first product bottles 109 for bottles B that are filled with a first product. The first product may possibly be provided by a first product mixer 123 that is connected to the filling machine 105, for example, through a conduit for first product 121, and bottles B that are filled with a predetermined volume of liquid beverage filling material, that is, the first product, are then labeled by a labeling module 126 in the labeling arrangement or labeling station 108 having at least one labeling unit, device, or module for first product 108*a*, each unit having a head, corresponding to this first product delivered from first product mixer 123 to the beverage filling machine 105 and thence to the corresponding bottles B. One embodiment of a labeling station, or labeling machine, is described in greater detail herein below with reference to FIG. 1.

A second output that is formed by a conveyer arrangement to convey second product bottles 110 is provided for those bottles B that are filled with a second product. The second product may emanate from a second product mixer 124 that is connected, for example, through a conduit for second product 122 to the filling machine 105, and these bottles B filled with a predetermined volume of liquid beverage filling material comprising the second product are then correspondingly labeled by a labeling module 126' in the labeling arrangement or labeling station 108 having at least one labeling unit, device, or module for first product 108*a*, each unit having a head, corresponding to this second product.

A third output, for example, formed by a conveyer arrangement to convey incorrectly labeled bottles 111, removes any bottles B which have been incorrectly labeled as may have been determined by an inspecting device or an inspecting station, or an inspecting module 128 that may possibly form a part of the labeling arrangement or labeling station 108 having at least one labeling unit, device, or module for first product 108*a*, each unit having a head.

In FIG. 1A item 112 is a central control arrangement or, expressed differently, a controller with a computer to process algorithms, which controls the operation of the above-referenced system or plant.

The beverage filling machine 105 is preferably of the revolving design, with a rotor 105', which revolves around a vertical machine axis. The rotor 105' is designed to handle the bottles B by the neck, and is described further herein below with respect to FIGS. 1–4. A filling arrangement 114 having at least one filling device, element, apparatus, or valve 114*a* comprises an apparatus configured to introduce a predetermined volume of liquid beverage filling material into the interior of bottles B to a predetermined level of liquid beverage filling material. Furthermore, the filling device or apparatus comprises an apparatus configured to terminate the filling of bottles upon liquid beverage filling material reaching the predetermined level in bottles B. In other words, the filling arrangements 114 having at least one filling device, element, apparatus, or valve 114*a*, are configured and disposed to provide a predetermined flow of liquid beverage filling material from the source thereof, such as, product mixers 123 and 124, into the bottles B.

The toroidal vessel 117 is a component, for example, of the revolving rotor 105'. The toroidal vessel 117 can be connected by means of a rotary coupling or a coupling that permits rotation, and by means of the conduit for first product 121 to the external reservoir or first product mixer 123 to supply the product, that is, product mix 1, for example.

As well as the more typical filling machines having one toroidal vessel, it is possible that in at least one possible embodiment a filling machine could possibly be utilized wherein each filling arrangement 114 having at least one filling device, element, apparatus, or valve 114*a* is preferably connected by means of two connections to a toroidal vessel 117 which contains a first product, say by means of a first connection, for example, the conduit for first product 121, and to a second toroidal vessel which contains a second product, say by means of the second connection, for example, the conduit for second product 122. In this case, each filling arrangement 114 having at least one filling device, element, apparatus, or valve 114*a* can also preferably have, at the connections, two individually-controllable fluid or control valves, so that in each bottle B which is delivered at the inlet of the filling machine 105 to a filling position 113, the first product or the second product can be filled by means of an appropriate control of the filling product or fluid valves.

It will be understood that while a two-product assembly or system of a bottling plant is illustrated in FIG. 1A, the disclosure is equally applicable to single-product installations, or other commensurate embodiments.

Figure 1B:
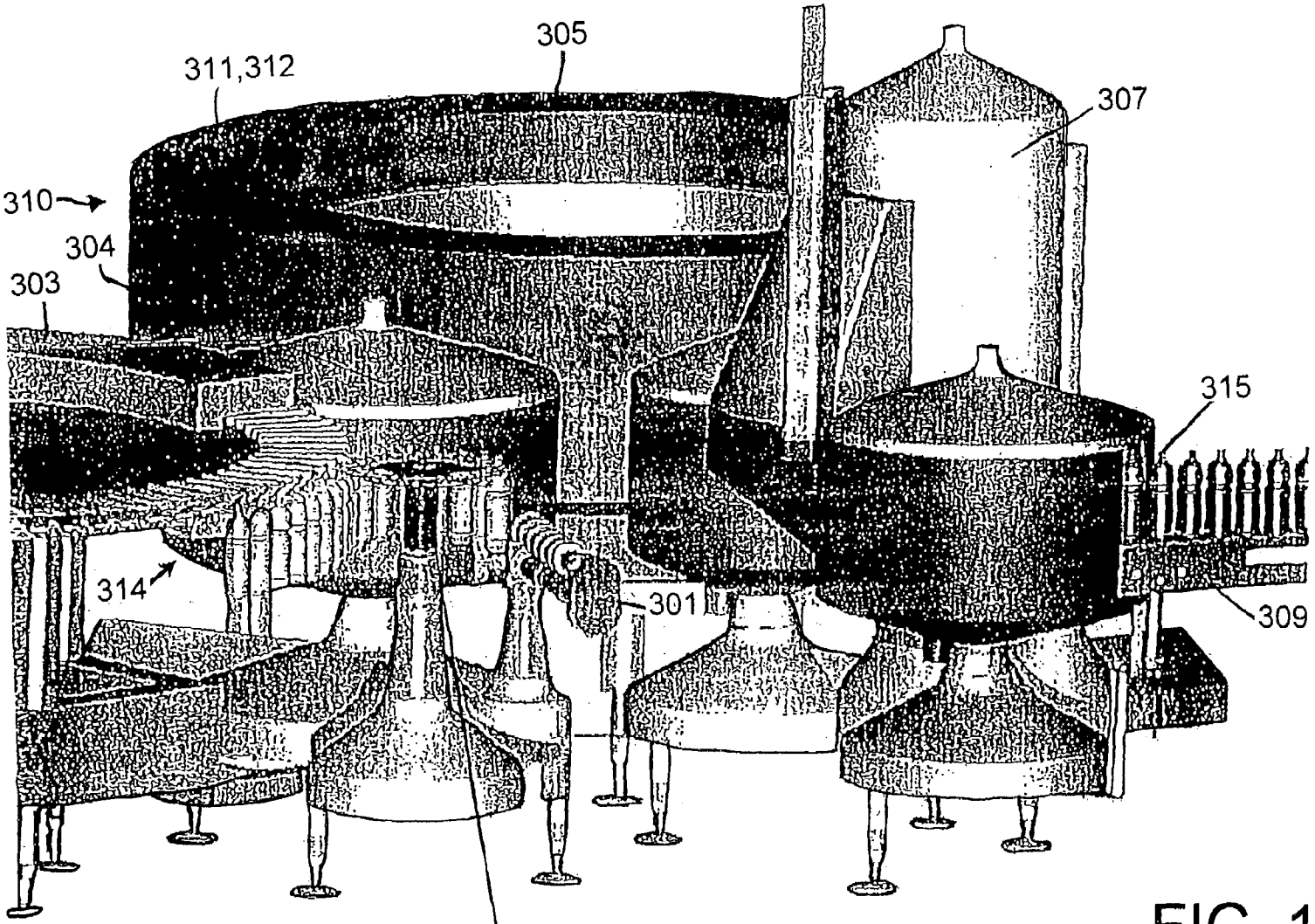
FIG. 1B PRIOR ART
FIG. 1B is a perspective illustration of a state of the art machine arrangement for rinsing, filling, and closing of containers with a rotating annular chamber, partly shown as an exploded view.

FIG. 1B is a perspective illustration of a state of the art machine arrangement for rinsing, filling and closing of containers, for example, PET bottles (polyethylene terephthalate bottles).

The containers are passed to the machine arrangement by way of known conveyers, that are not shown in greater detail but briefly described above with reference to FIG. 1A, and a dividing screw 301 serves to arrange the containers so as to be divided and spaced from one another. Transport star 302 passes the containers initially to rinser 303. The PET bottles that are illustrated in this described embodiment are interiorly and exteriorly rinsed with a suitable treatment liquid, for example, sterile water, or a disinfecting liquid. In another suitable configuration of an equipment installation, in place of a rinser, other cleaning and disinfecting equipment, such as, immersion bath sterilizers, and/or plasma disinfecting equipment, may be disposed ahead of the filling machine 305. Upon the PET bottles having been conveyed through the rinser 303, they are passed by way of further transport star 304 to the actual filling machine 305. Next in line of the filling process, the PET bottles are removed by further transport star 6 from the filler 5 and are passed to the closer 307. Subsequently, further transport star 308 removes the PET bottles from the closer 307 and transfers the bottles to conveyer 309 that passes the PET bottles to the next processing step, for example, a labeling station, say labeling station 108 in FIG. 1A. The components hitherto used in a container handling installation, such as, rinser 303, filler 305, closer 307, and transport stars 302, 304, and 306 are of known design and can have various configurations.

In the illustrated embodiment, the filling machine 305 is of a rotating design. The rotating part of the filling machine, in one embodiment the so-called carousel, is surrounded by an enclosure 310 that does not rotate, that is, the enclosure is stationary. The upper portion of the enclosure 310 configures an annular channel 311 that fully surrounds the carousel and that is separated from the carousel by a narrow annular gap 312.

The enclosure 310, furthermore, configures, in conjunction with the geometric design of the rotating carousel of the filling machine 305 a treatment chamber whereby the enclosure 310 is configured in such a way that there remains a narrow gap 314 at the lower end of the enclosure between the enclosure 310 and the rotating carousel of the filling machine, with this gap fully extending about the circumference of the carousel.

The annular channel 311 is supplied with a processing gas that is under an over-pressure by means of at least one input conduit 313, with the processing gas comprising, for example, sterile air, carbon dioxide, hydrogen peroxide, or another suitable gas or gas mixture. By way of openings that are not shown in greater detail in the annular channel 311, the processing gas initially flows into the above described treatment chamber and subsequently flows in a widened stream in the direction of the openings that are present, that is, the annular gaps 312 and 314. Since the processing gas is continuously exiting at these openings, any ingress of germs and/or other dirt particles is securely avoided.

Figure 1C:
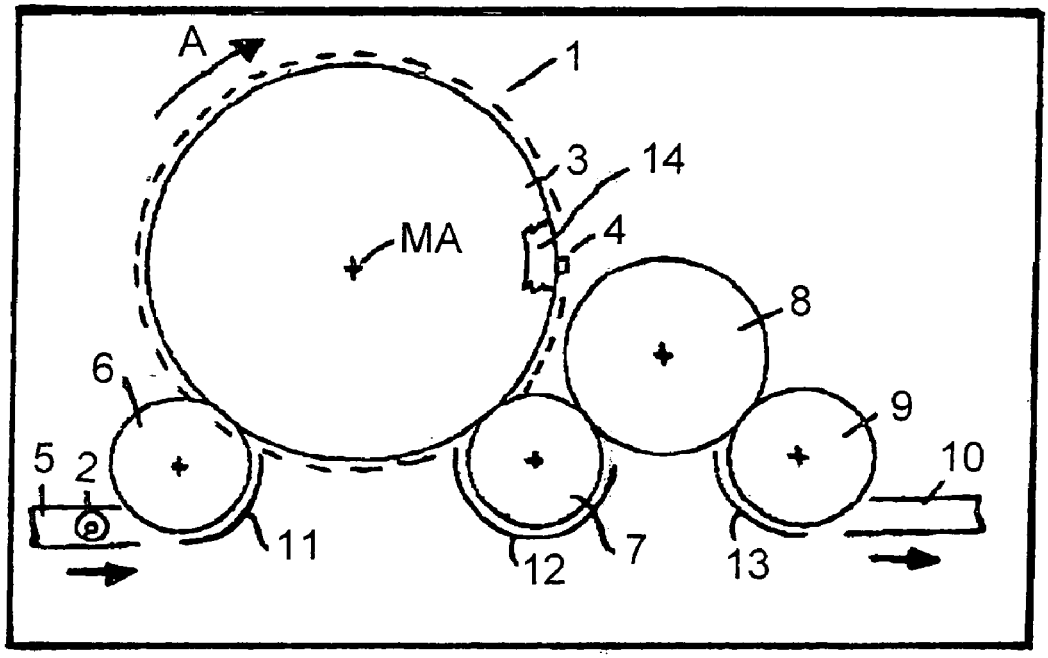
FIG. 1C shows a possible embodiment of a container handling machine with an aseptic filling system or a clean room, which aseptic filling system or clean room is represented by a box around the container handling machine.
Figure 2:
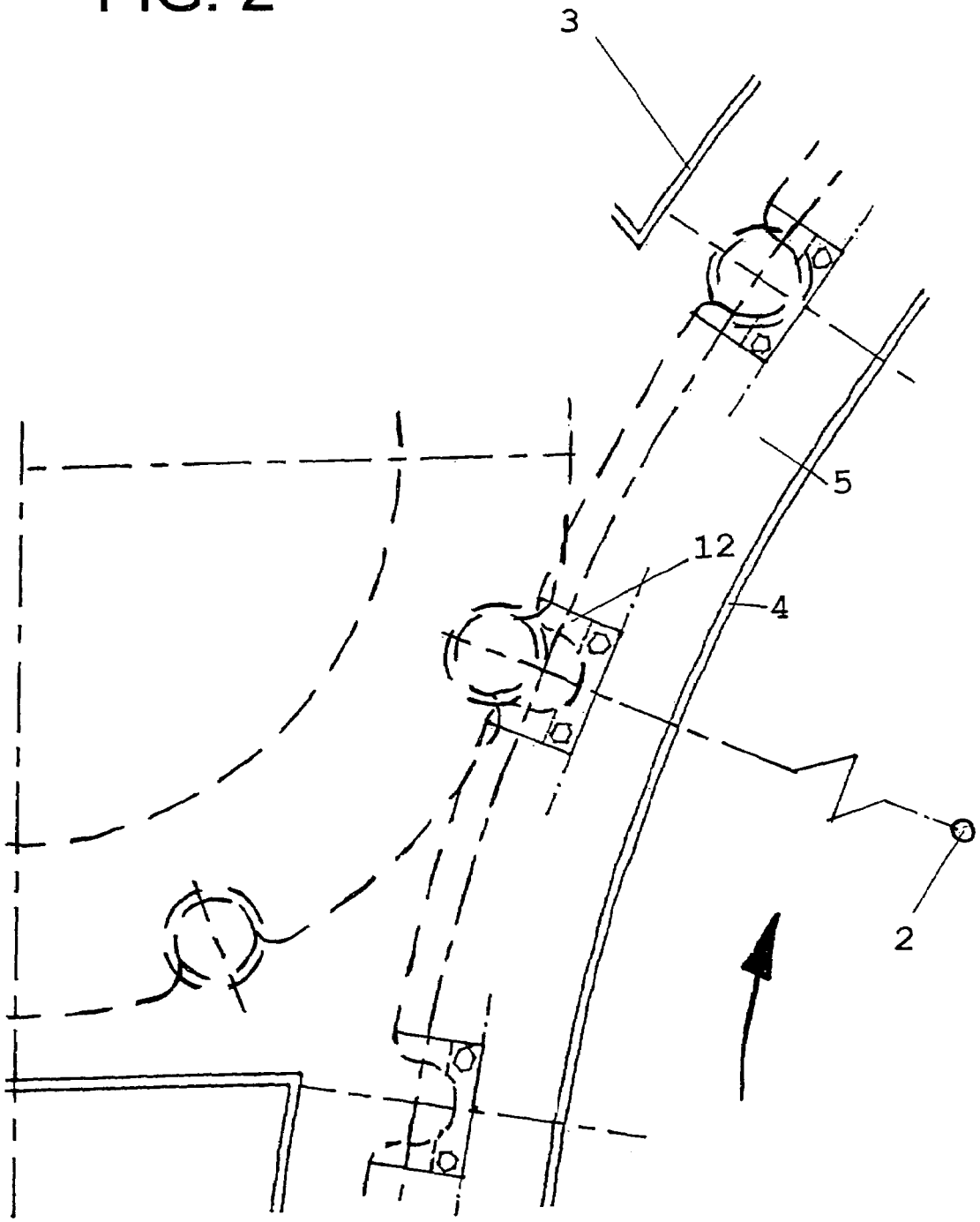
FIG. 2 is a simplified plan view of the infeed area of a corresponding bottle handling machine.

FIG. 1C shows a possible embodiment of a container handling machine with an aseptic filling system or a clean room, which aseptic filling system or clean room is represented by a box around the container handling machine. In this possible embodiment, the aseptic filling system may encompass the entire container handling machine, or more than just the tops of the bottles, as shown in FIG. 1.

FIG. 1 shows, in a cross section drawing, a bottle handling machine, which can be a rinser or capper, for example. In the illustrated exemplary embodiment the bottle handling machine is a filling machine that employs a rotating design. The rotating portion of the filling machine, which is called the carousel 1, is realized so that it can rotate around the axis of rotation 2 of the machine.

The rotating carousel 1 is surrounded by paneling 3 that does not rotate, i.e. it is stationary.

A vertical inside wall 4 is an essential component of the carousel 1. This inside wall 4, the stationary paneling 3 in connection with the guide plate 10 and the pivoting receptacles 12 together form a ring-shaped channel 5 which encloses as closely as possible all the handling stations 6 of the bottle handling machine, except for those located in the bottle infeed and discharge areas.

The ring-shaped channel 5 is filled by means of at least one air inlet nozzle 7 with the controlled atmosphere preferred by the customer, whereby this atmosphere is at a pressure that is higher than atmospheric pressure.

The controlled atmosphere can be, for example, sterile air, $CO_2$ or another suitable gas or mixture of gases. Because the controlled atmosphere is discharged continuously from the at least one air inlet nozzle 7, any penetration of germs and/or other particles of dirt into the ring-shaped channel 5 can be reliably prevented.

To maintain a slight overpressure in the clean space which is as uniform as possible throughout the enclosed space, it has been found to be particularly advantageous to install a plurality of air inlet nozzles 7 at uniform intervals on at least one of the vertical peripheral surfaces of the ring-shaped channel 5.

To keep the loss of the controlled atmosphere and the related costs as low as possible, the connection between the rotating portion and the stationary portion of the ring-shaped channel 5 consists only of a ring-shaped gap and the contact surface 9 between the containers 11 and the guide plate 10 or the gaps in the above-mentioned contact surface. These connecting points are realized so that they present the greatest possible flow resistance to counteract the escape of the controlled atmosphere. These connecting points can also be equipped with additional seals or gaskets.

Additional openings through which the controlled atmosphere can escape are the pivoting receptacles 12 for the containers which, as noted above, on devices of the prior art are adapted to the largest diameter of the container neck of the containers to be handled.

The present application teaches that these pivoting receptacles 12 are realized so that they are interchangeable, i.e. so that during the operation of a bottle handling machine of this type, the loss of the controlled atmosphere is significantly reduced by the adoption of this measure.

To make the receptacles 12 interchangeable, all the detachable connection techniques or types of connections known from the prior art can be used, without going beyond the scope of the technical teaching of this application.

For example, the receptacles 12 can be fastened by screws or bolts, rivets, plug-and-socket or press-fit connections or they can be clamped in position or otherwise fastened using any desired combination of these methods. Stops and/or centering elements such as bolts, screws, conical components, diagonal surfaces etc. can also be used for positioning, and offer many advantages.

Further, in one possible embodiment, the receptacles 12 can be different sizes to accommodate different sizes of bottles or containers, such as, for example, two-liter or three-liter bottles.

In an additional, independent development, the receptacles 12 are located in a fixed manner on the bottle handling machine, i.e. they are not interchangeable. The size and geometry of these receptacles 12 that are permanently fastened to the bottle handling machine are adapted to the largest bottle neck diameter to be handled. The receptacles 12 can be adapted to varying container neck diameters by a variety of inserts of different sizes which are guided and/or positioned by separate guides and/or centering devices that are provided on the fixed receptacles 12, whereby the inserts can also be fixed in position by said guides and/or centering devices, as well as by additional means.

The receptacles 12, whether or not they are interchangeable, can also be made non-rotating or non-pivoting without going outside the scope of the present application.

If the receptacles 12 are non-rotating and non-pivoting, in the event of a disruption, malfunction or other problem the user will not be able to remove a container in any arbitrary position of the rotation of the carousel 1 from the ring-shaped channel 5. With such a configuration, a corresponding extraction position is provided, for example, in the vicinity of the container discharge from the carousel 1. The advantage of such a process lies in the lower cost of manufacturing such a device.

Additional advantages can be achieved if the receptacles 12 are adapted not only to the varying diameter of the container necks, but if the receptacles 12 are also adapted to the different shapes of the container heads. When plastic bottles which generally have a neck ring are being handled, for example, it is generally advantageous to realize the receptacles 12 so that the neck ring is enclosed and guided at least partly on its top and bottom by the receptacle 12.

When glass bottles, which generally do not have a neck ring and are therefore transported and/or elevated by a bottom support that can be realized in a number of different ways, are being handled it is very beneficial to adapt the receptacles 12 to the shape and size of the bottom edge of the capping area of the container being handled.

When different containers, e.g. 1, 1.5 or 2 liter containers, are being handled that have identical or at least comparable dimensions in the vicinity of their mouths, it is highly advantageous to process these containers with only one receptacle 12 or with only one insert.

In both cases, the advantages lie both in the reduction of the loss of the controlled atmosphere and in the improved guidance of the containers.

Figure 3:
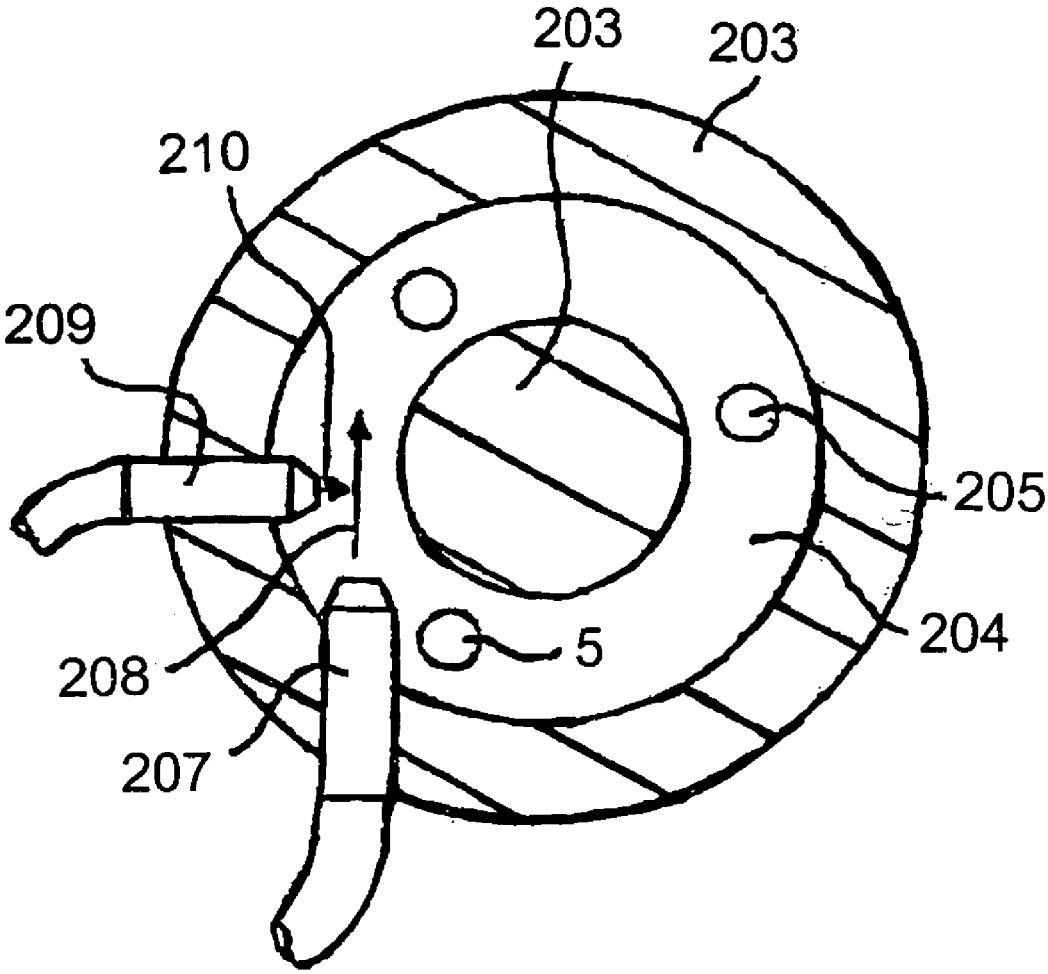
FIG. 3 is a cross-section through a hydrogen peroxide evaporator in accordance with one embodiment of the present application.

In another possible embodiment, as is shown in FIG. 3, an air nozzle 207 leads in tangential manner into the annular channel 204, the air nozzle generates a bundled air jet 208, that is introduced in tangential manner, and the air nozzle generates a circular flow in the annular channel 204, while the air stream flows from the annular chamber to the outlet 201 via the channels 205 and the collection chamber 206.

A hydrogen peroxide nozzle 209 is disposed in the housing block 203 in such a way that it generates a liquid jet 210 transverse to the air jet 208 at a distance from the air jet, and this is done in such a way that the liquid jet 210 impinges on the air jet 208 in free space within the annular channel 204.

The hydrogen peroxide nozzle 209 is configured in such a manner that it generates a solid stream, liquid jet that has a diameter of a few tenths of a millimeter. Salt crystals present in the hydrogen peroxide or, respectively, in the mixture comprising hydrogen peroxide/water that is usually used, or other solids that lead to plugging when use is made of customary nozzles, are permitted to pass through nozzle as a liquid jet of this thickness without difficulties and without the hydrogen peroxide nozzle 209 becoming plugged.

The liquid jet 210 impinges on the air jet 208 at a point of crossing and is taken along by this air jet by means of streaming air that is flowing with a suitable stream velocity, and the liquid jet is shredded into droplets. In at least one possible embodiment of the application this interaction of the stream of air and the stream laden with hydrogen peroxide may possibly entail atomization of the hydrogen peroxide droplets. The spray mist comprising fine droplets that is generated in this manner, moves, together with the air jet, that is generated by the air jet 208 that is introduced in tangential manner, in a circular manner in the annular channel. Hereby, the fine liquid droplets generated at the point of crossing of the jets are transported, by centrifugal force, substantially completely, to the circumferential wall of the annular chamber 204, so as to be deposited thereon.

There the droplets evaporate. The mixture of air and hydrogen peroxide-water vapor subsequently also passes through the channels 205, that are also heated, to the outlet 201. As required, any liquid droplets still present can be subjected to post-evaporation in the channels 205, and a re-condensation in the evaporator is precluded.

In an embodiment that is not illustrated, instead of the annular chamber 204, any other evaporation chamber may be provided in which the spraying of hydrogen peroxide by crossing jets of air and liquid is carried out. It is preferred that such a chamber can have a round circumferential wall and the air jet 208 is tangentially blown in, as is illustrated in FIG. 3, so as to generate similar effects as in the case of an annular chamber.

Instead of straight channels 205, also circuitous paths, for example, spirally disposed channels, can be provided between the evaporator chamber 204 and the outlet 201, so as to effectuate an improved post-heating over a longer distance.

It will be appreciated that the application is applicable to new containers and correspondingly to recycled containers. The containers may be of any variety and including, but not limited to, bottles, glass bottles or plastic bottles, cardboard containers, plastic containers, cans, cup-shaped containers, and the like receptacles.

Figure 4:
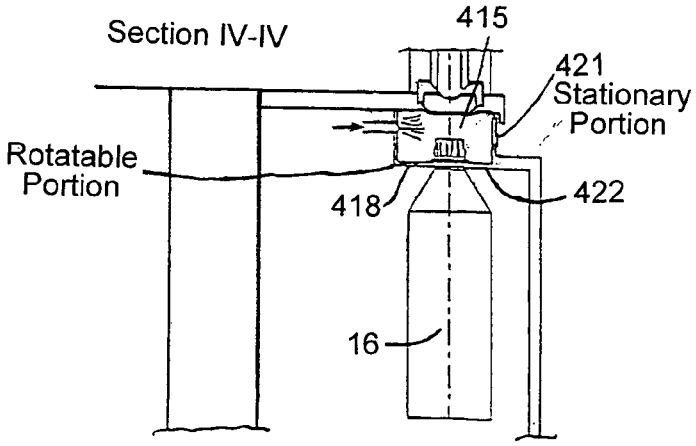
FIG. 4 is a detail illustration of an embodiment of the housing in the region of the filling machine, along line 4—4 in FIG. 6

In accordance with the embodiment that is illustrated in FIG. 4, the clean chamber comprises a chamber, or a space, or a room 415 that surrounds only a portion of the beverage containers 16, namely, at least the mouth portions 417 thereof. In other words, chamber 415 is generally configured by rotatable portions or components 418 and by stationary portions or components 421. In this, the holders, supports and centering arrangements or centering devices 419 for the bottle mouths 417 are possibly directly disposed at the lower horizontal wall surface 418 that is rotating with the machine carousel. Such elements 419, accordingly, can comprise simple semicircular openings. On the other hand, other embodiments can be provided for the respective purpose. Thus, it is within the scope of the application that at the rotating wall of the chamber there are provided specially configured support fingers, or clamping fingers, and the like that can be accessed in the input regions and in the output regions for holding and for transferring. The outwardly directed centering of the circulating containers, or, respectively, the mouth portions thereof, is assuredly provided by a stationary chamber portion 420. This chamber portion 420 is practically configured rectangularly and it possibly forms a vertically projecting outer wall 421 and the inwardly directed centering wall 422 that can also be provided with a seal for sealing the annular gap. For enhancing cleaning, the centering wall 422 can also be disposed somewhat slopingly. The input region and the output region of such a filling machine 5 are possibly formed by rotating stars 4 and 408.

Figure 4A:
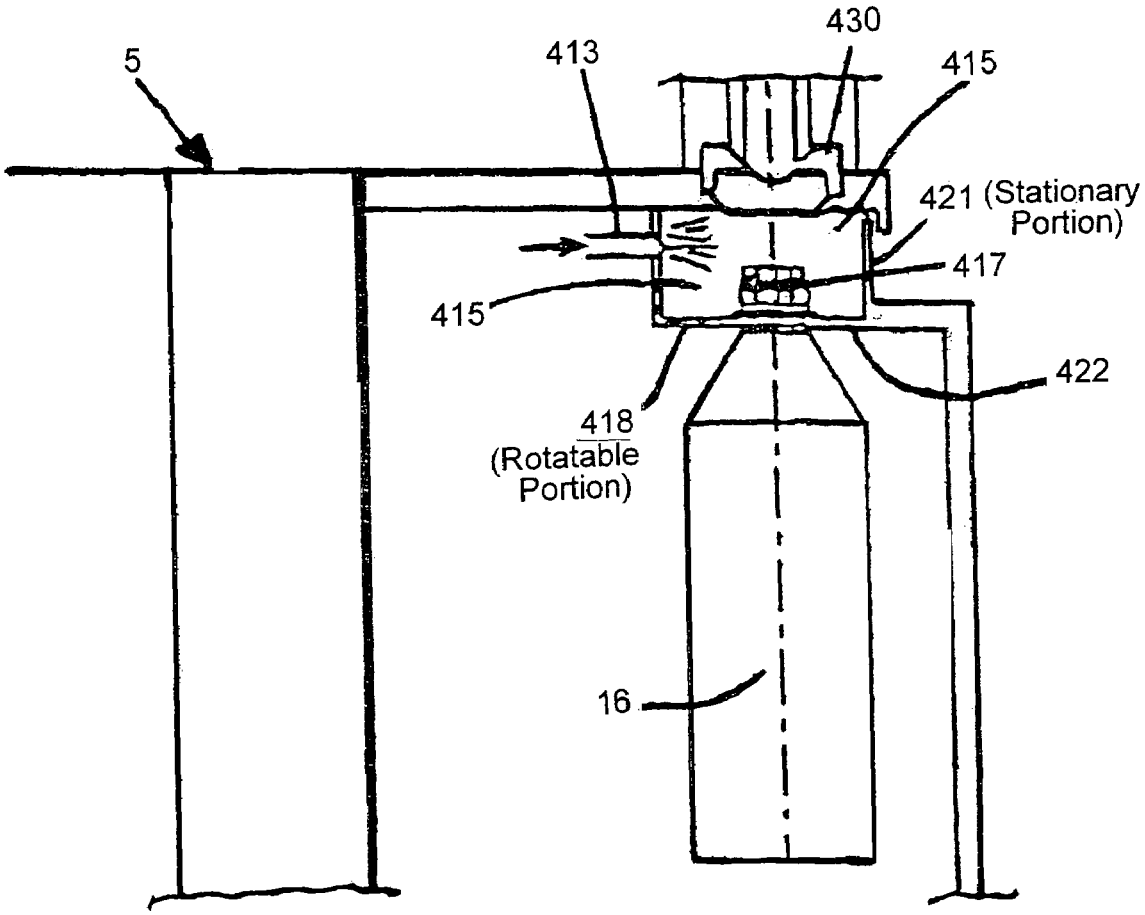
FIG. 4A is a view similar to FIG. 4 drawn to a larger scale and including identification of further detail.

FIG. 4A is a view similar to FIG. 4, but drawn to a larger scale and additionally showing a filling valve 430.

Figure 4B:
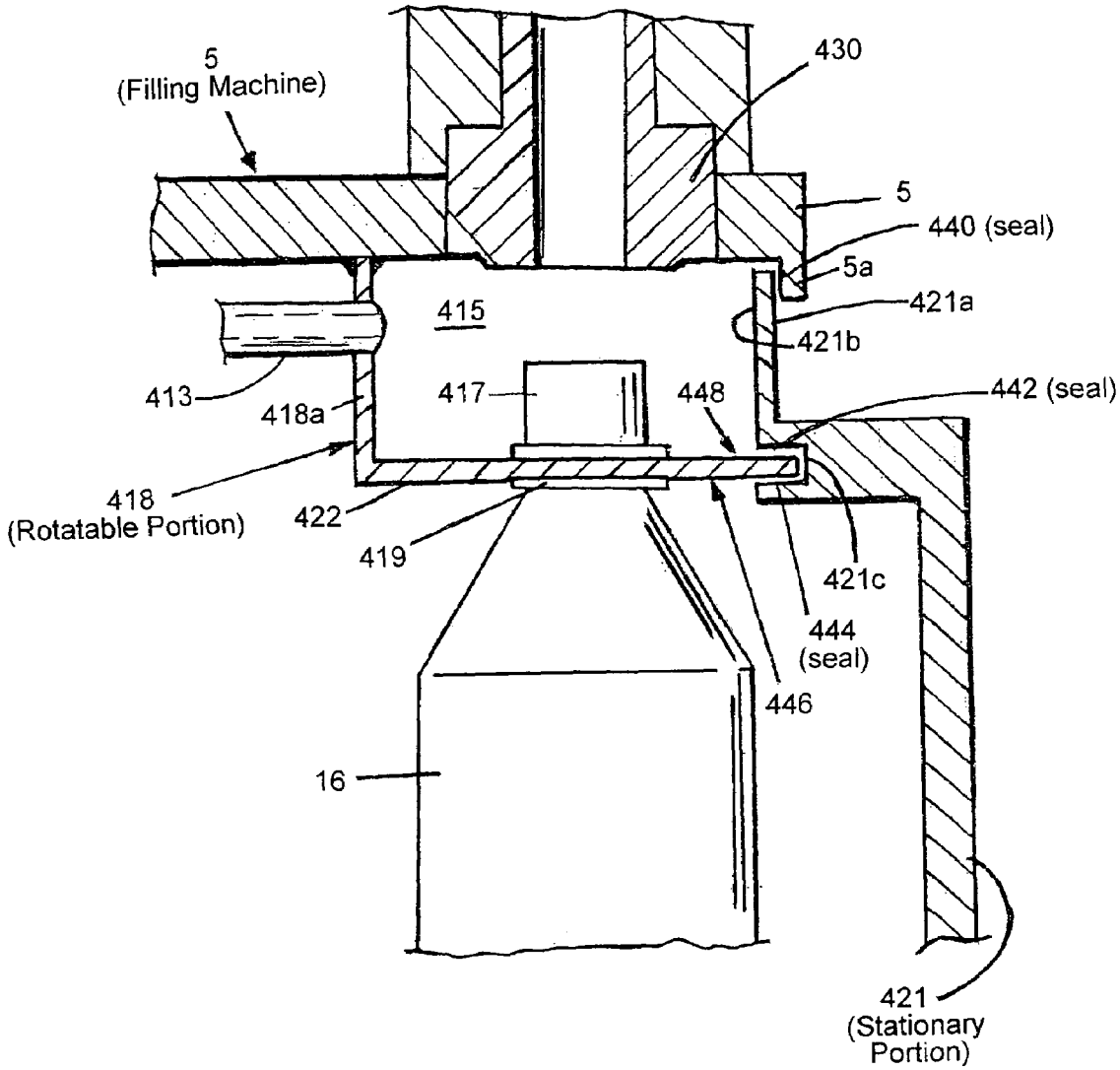
FIG. 4B is a view similar to FIG. 4 drawn to a larger scale and including identification of further detail.

FIG. 4B illustrates in particular detail a seal arrangement 440 between surface 5*a* of a portion of filling machine 5 and surface 421*a* of stationary wall portion 421*b*. There may be provided similar seal arrangements 442 and 444 between the projecting portion of centering wall 422 and the groove 421*c* of the stationary wall 421. The centering wall 422 may comprise a slot, or slots, or similar openings 446 that may be covered by a cover, or covers, 448. Such covers 448 may possibly be actuated by cam arrangements configured and disposed to move the covers 448 to cover and uncover the slots or openings 446. Seals may be superfluous in at least one embodiment in which the disinfecting medium is introduced into chamber 415 with sufficient pressure to prevent ingress of microorganisms.

The conduit 413 is introduced, in one embodiment, through a vertical wall 418*a* that is part of the filling machine 5.

Figure 5:
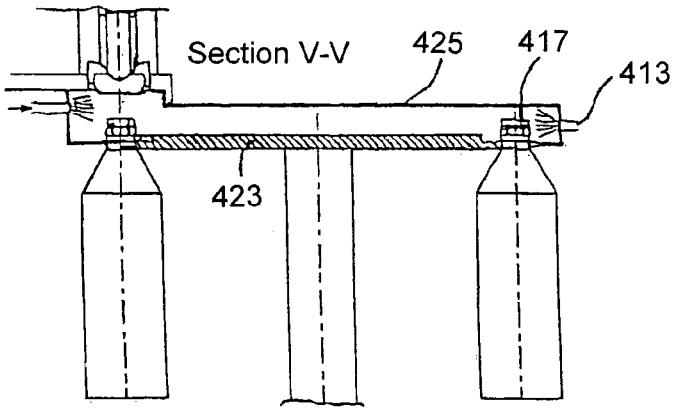
FIG. 5 is a cross-section along line 5—5 in FIG. 6.
Figure 5A:
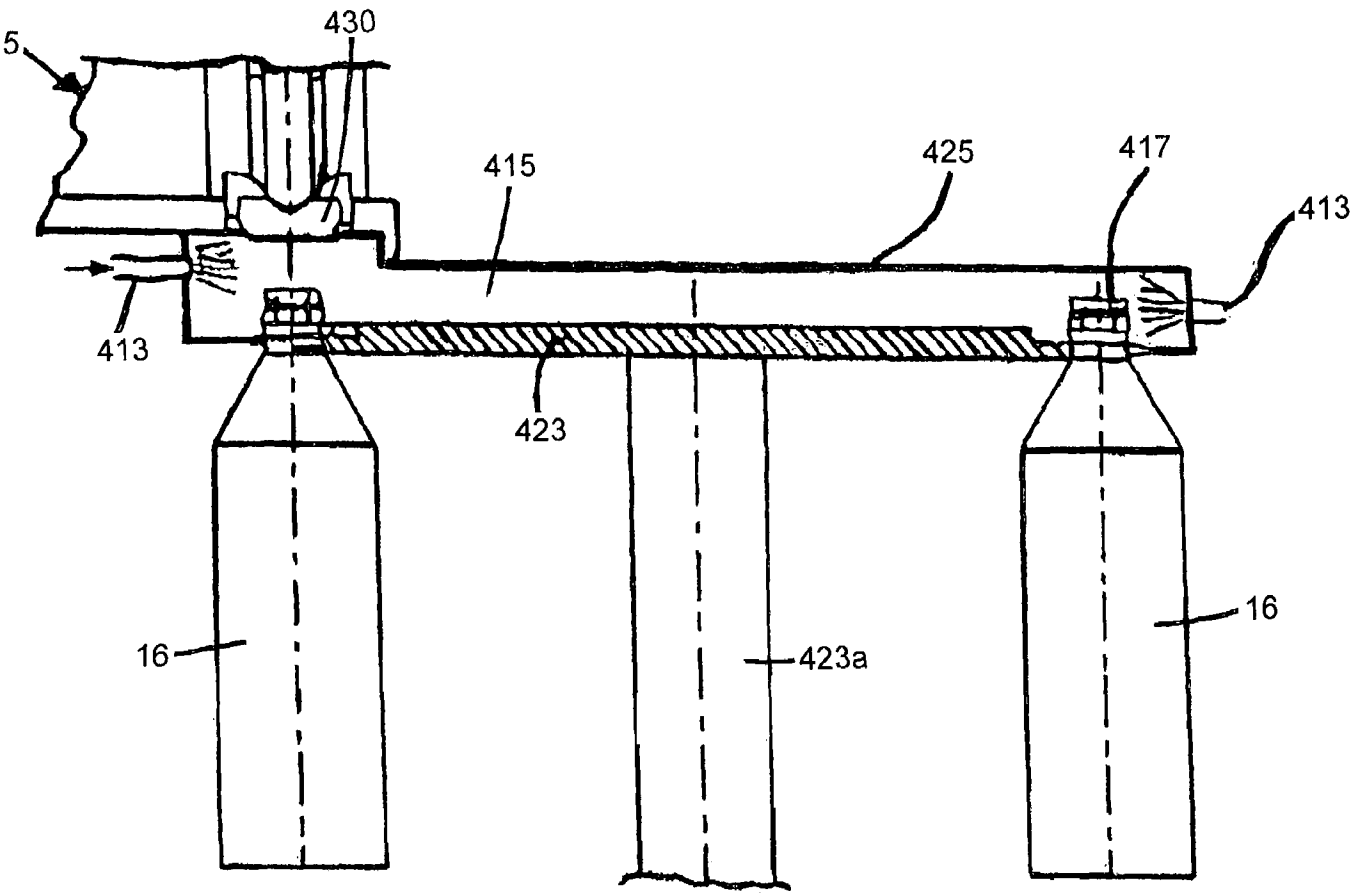
FIG. 5A is a view similar to FIG. 5 drawn to a larger scale and including identification of further detail.

In FIG. 5A, the flat disc 423 is shown to be rotatably disposed by mens of a shaft 423*a*. FIG. 5A also indicates a filling valve 430, as is known in the art.

Figure 6:
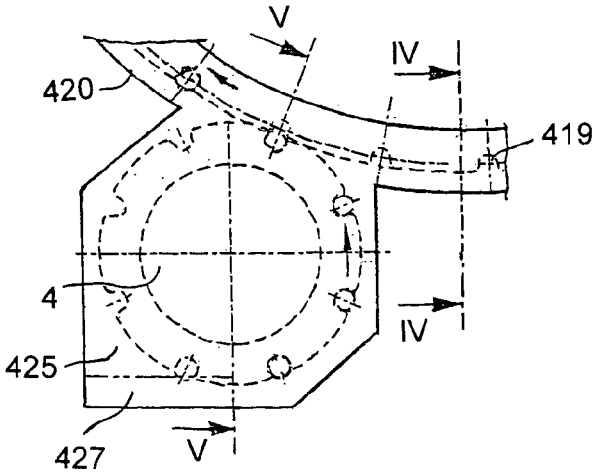
FIG. 6 is a top plan view of the enclosed region of an input star conveyer to feed bottles to the filling machine.

In accordance with the embodiment of FIG. 5 and FIG. 6, the stars are provided by a flat disc 423 with corresponding recesses, supports, and/or centering structures 424. These discs are enveloped by a stationary upper hood component 425 whereby the rotating disc surface provides the lower limit of the chamber. For introduction and removal of the mouth in the transfer region of the filling machine 5, and the like equipment, there can be provided transfer devices, cover sheets 426, and the like transfer elements, or arrangements to move bottle from the star wheel recess 424 to the filling machine recess 419, as is illustrated by way of an input embodiment in FIG. 6 and FIG. 6A.

The container mouths are possibly introduced at a narrow entrance opening and exit opening 427 of the star pockets, or, respectively, the centering devices 424, or, respectively, removed from these upon completion of processing. For introduction of the sterile medium, inlets, or nozzles 413 can be provided at various locations, so as to maintain a rather constant and a rather all-pervasive low over-pressure in the clean chamber 415. However, it is within the scope of the various embodiments to carry out the introduction of the sterile medium at the container input side, whereby this sterile medium, or, respectively, a portion thereof, flows through the clean chamber 415 in the direction of rotation of the equipment while utilizing the rotational flow, compare arrow $R_{FM}$ and arrow $R_{SW}$, in FIGS. 4A and 6A.

Figure 7A:
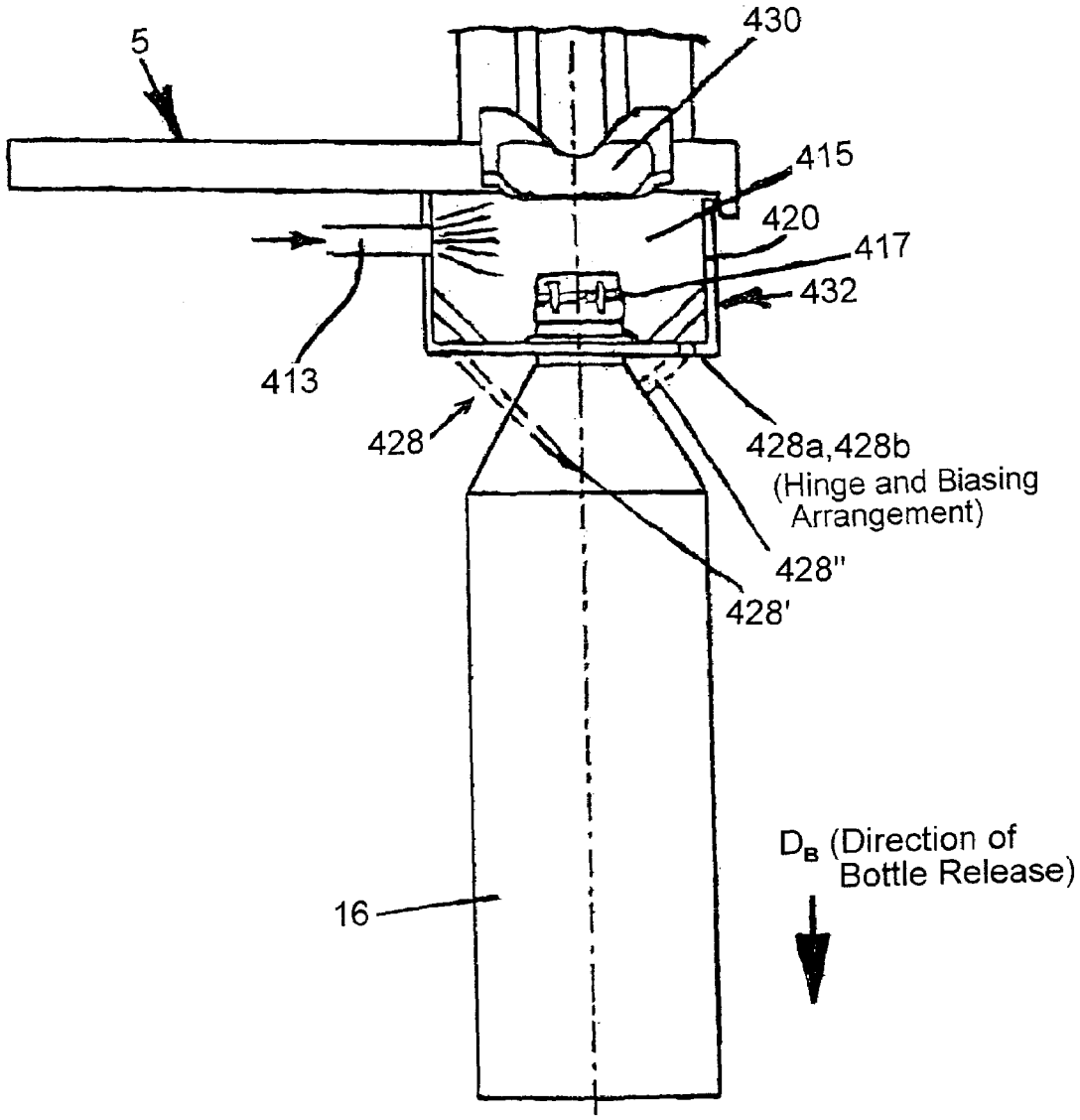
FIG. 7A is a view similar to FIG. 7 drawn to a larger scale and including identification of further detail.

In accordance with the embodiment illustrated in FIG. 6, the supports, and/or the centering devices 424 that carry the mouths 417, or, respectively, the regions thereof, can be hingedly disposed, for example, to be swung in outward direction, or in downward direction. For this, the corresponding hinge mechanism 425 can be held with torsion springs 427 at rotary hinges 426. In other words, FIG. 7A suggests a hinge 428*a*, as is well known, and a biasing element, such as, a spring 428*b*, as is well known for spring-biased hinge arrangements, for example, a torsion spring, forming part of a release mechanism or arrangement 428 having components 428' and 428" for bottles 16 that may need to be removed in downward direction $D_B$ upon a operating and/or system failure in the filling process. There may also be provided a stop arrangement 432.

Figure 7B:
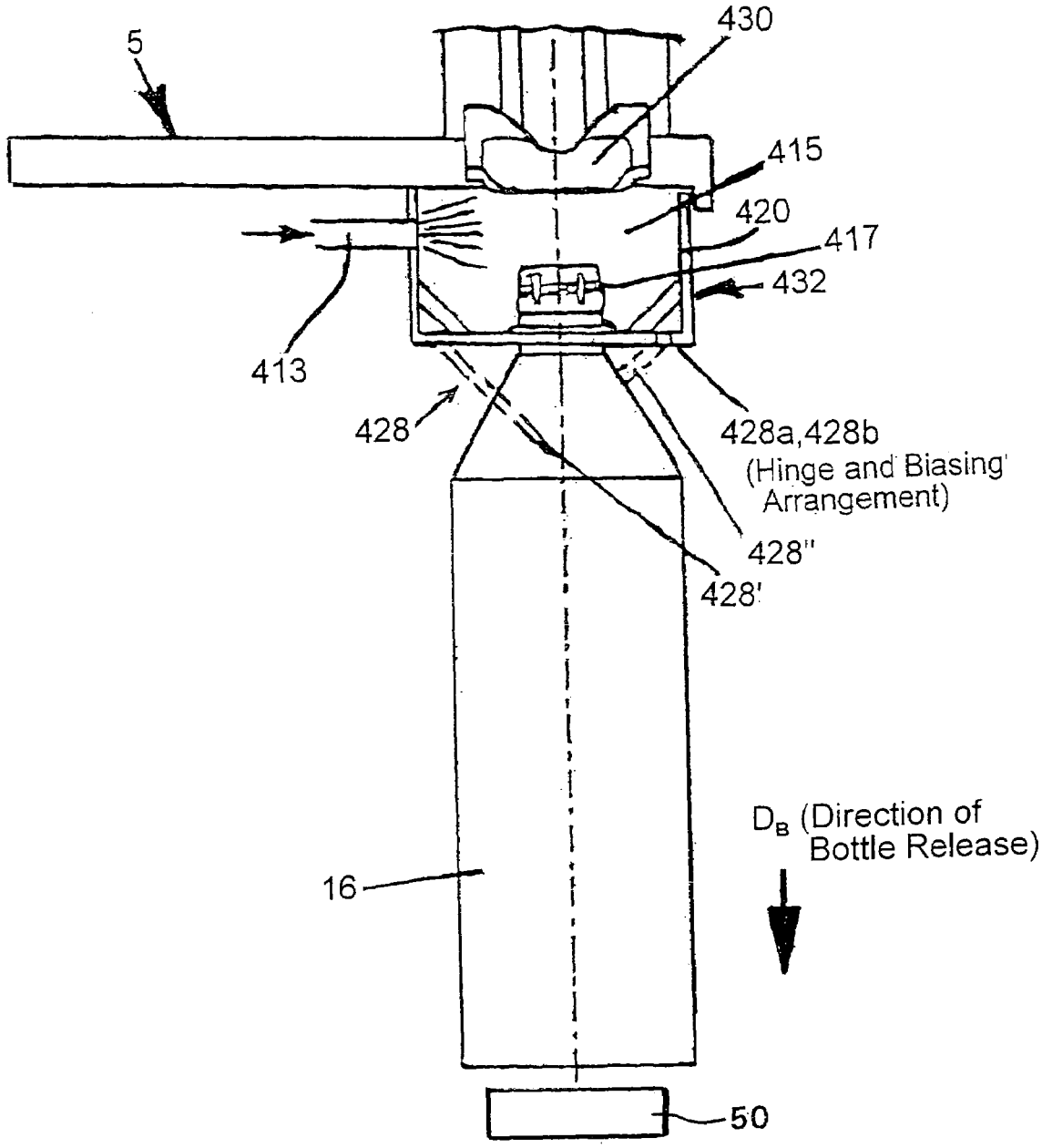
FIG. 7B is a view similar to FIG. 7 and including identification of further detail.
Figure 8A:
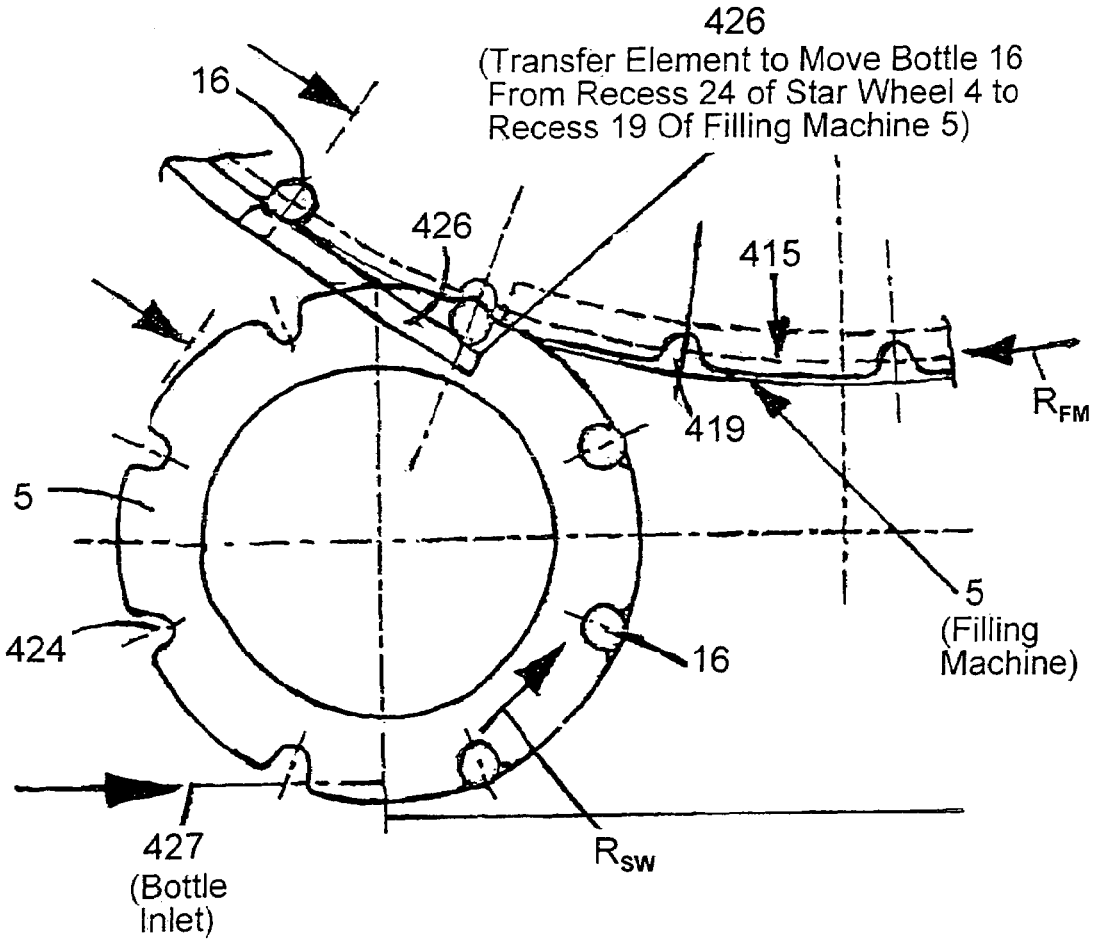
FIG. 8A is a view similar to FIG. 8 drawn to a larger scale and including identification of further detail.

In the case where the containers 16 are introduced from below in upward direction in the manner as is done in known filling machines that employ lifting elements, there are possibly provided openings at the lower side of the clean chamber. Movement of a bottle 16 into the corresponding opening, say slot 446 in FIG. 4B of this application, may be with play or without play. Flexible openings or retainers 419*a* and a lifting device 450 are illustrated in FIG. 7B of this application. In this way, the mouth portion 417 of a bottle 16 is introduced from below into the clean chamber 415 and is then surrounded in the chamber 415 by a disinfecting medium.

The bottles 16 may be introduced by lifting devices 450 which are well known in the art, from below into the clean room or chamber 415.

In other words, a container filling machine 5 may possibly of a design of a rotating machine that has a plurality of filling elements or filling valves 430 the rotor 105'. Support plates or support tables that can be raised and lowered at the filling positions 113 are associated with the filling elements or valves 430, which support tables, for example carriers 113*a*, receive the containers 16 that are to be filled via input star wheels, for example transport star 4.

Further, a lifting device such as 450, that also lowers a container 16, is associated with each of these support tables, generally identified by reference numeral 113*a*, has the purpose of raising the containers 16 that are disposed on the support tables or carriers 113*a* towards the filling devices or valves 430 and to press the containers 16 against the filling valves 430. In order to accomplish this function, these lifting devices may possibly comprise a combination of a fixed piston and a moveably disposed cylinder structure that surrounds the piston. The structural components are disposed vertically, and with the piston being rigidly connected to the rotor of the container filling machine 5. The cylinder can be moved up and down in a vertical direction. The cylinder chamber or cavity that is established between the fixed piston and the moveable cylinder, is in most cases operated by compressed air, the compressed air being passed through a bore within the piston, such that the cylinder is moved in a vertical direction to an upper position. This movement may possibly be limited by a roller that is secured to the cylinder, which roller is configured to rotate about its longitudinal axis, with the roller contacting a curved stationary cam structure. By way of the rotating movement of the rotor of the container filling machine, the roller rolls upon the curved path of the cam structure, that is, it follows the course of the curved cam structure and simultaneously carries out an upwardly directed movement and a corresponding downwardly directed movement, which movements, due to the configuration of the design of the machine 5, are also carried out by the support table 113*a* and, accordingly, a container 16 supported on a support table 113*a*.

The curved path of such cam structures is not disposed along the entire circumferential surface area or region of the rotor 105', but they rather extend only along a portion of the circumference, possibly in the region of the container inlet and the container outlet, where the receiving surface of the support table 113*a* needs to be disposed at the level of the transport structures that supply containers 16 and also remove containers 16.

Figure 6A:
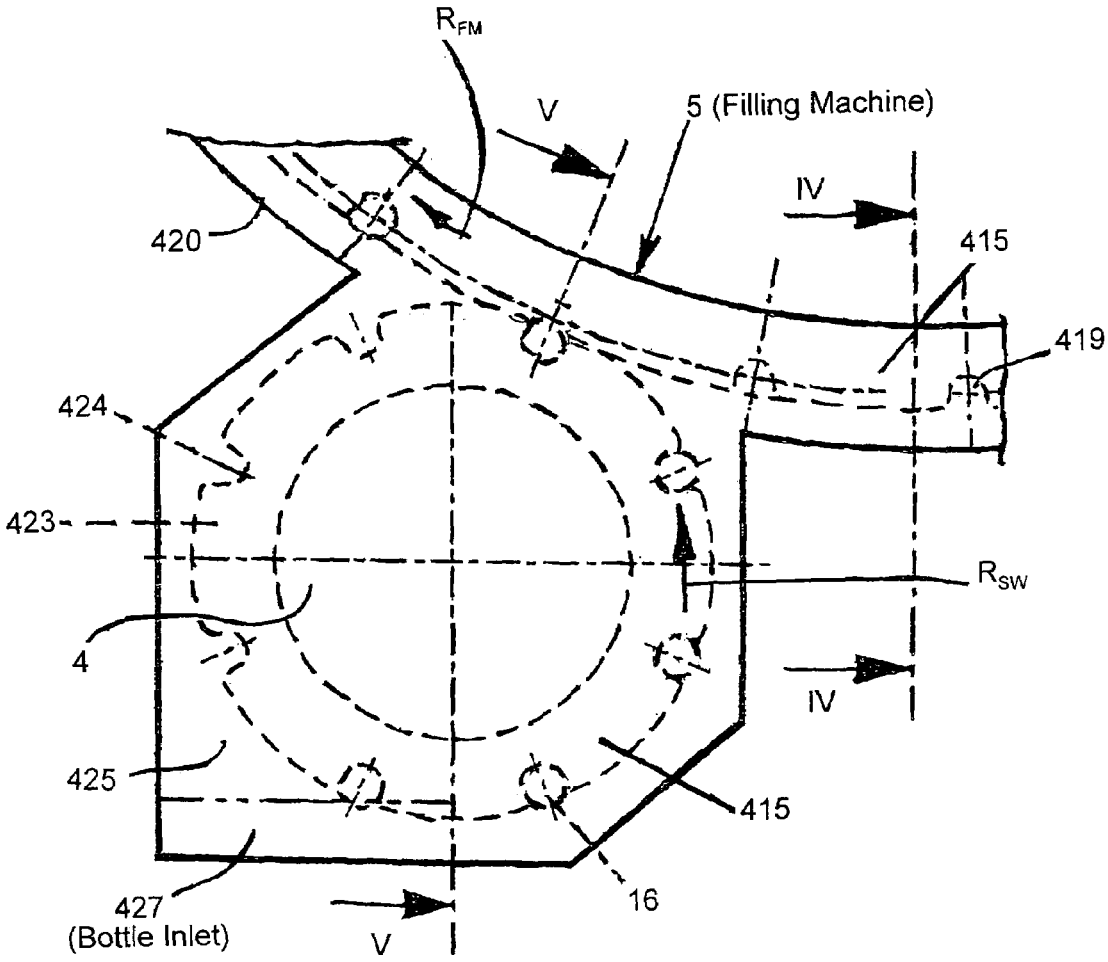
FIG. 6A is a view similar to FIG. 6 drawn to a larger scale and including identification of further detail.

Thus, in the described embodiments, see, for example FIG. 1A of the present application, downstream of rinser station 3, in the direction of travel as is indicated by the arrow A, the rinsed bottles 16 are transported to beverage filling machine 5 by means of conveyer line or conveyer arrangement 4 that is formed, for example, by a star wheel conveyer or a plurality of star wheels of a conveyer arrangement as is known in the art. The conveyer arrangement 4 may possibly have a star wheel that introduces bottles 16 into the filling machine 5 with a transfer element 426 being possibly employed as is schematically indicated in FIG. 6 and FIG. 6A of the present application.

One feature or aspect of an embodiment is believed at the time of the filing of this patent application to possibly reside broadly in a beverage bottling plant for filling bottles with a liquid beverage filling material, said beverage bottling plant comprising: a beverage filling machine; a bottle closing station; a bottle cleaning station; a bottle packaging station; a storage apparatus being configured and disposed to store a liquid beverage filling material; a beverage filling machine being configured and disposed to fill empty bottles with liquid beverage filling material; a conduit arrangement being configured and disposed to supply liquid beverage filling material from said storage apparatus to said beverage filling machine; said beverage filling machine comprising a rotatable structure; said beverage filling machine rotatable structure comprising a first ring-shaped disk structure configured to hold the tops of bottles; said first beverage filling machine ring-shaped disk structure comprising a plurality of interchangeable receptacles to hold the tops of bottles in said beverage filling machine; said rotatable beverage filling machine also comprising: a first beverage filling machine chamber being configured and disposed to confine the top of each bottle being processed and also being configured to dispose the lower portion of each bottle, having its top confined, outside said first beverage filling machine chamber; and a first beverage filling machine arrangement being configured and disposed to provide an anaerobic environment in said chamber to anaerobically contain solely the tops of the bottles being processed; said rotatable beverage filling machine also comprising a plurality of beverage filling stations, each beverage filling station comprising a beverage filling device for filling bottles with liquid beverage filling material; said filling devices comprising apparatus being configured to introduce a predetermined volume of liquid beverage filling material into interiors of bottles to a substantially predetermined level of liquid beverage filling material and to terminate the filling of beverage bottles upon liquid beverage filling material reaching said substantially predetermined level in bottles; a conveyer arrangement being configured and disposed to move empty bottles from said rotatable bottle cleaning station into said rotatable beverage filling machine; said conveyer arrangement for moving bottles from said rotatable bottle cleaning station into said rotatable beverage filling machine comprising: a second beverage filling machine ring-shaped disk structure configured to hold the tops of bottles; said second beverage filling machine ring-shaped structure comprising a plurality of interchangeable receptacles to hold the tops of bottles in said conveyer arrangement; a second beverage filling machine chamber being configured and disposed to confine the top of each bottle being processed and also being configured to dispose the lower portion of each bottle, having its top confined, outside said second beverage filling machine chamber; and a second beverage filling machine arrangement being configured and disposed to provide an anaerobic environment in said second beverage filling machine chamber to anaerobically contain solely the tops of the bottles being processed; said beverage bottling plant for filling bottles with a liquid beverage filling material further comprising: a rotatable bottle cleaning station being configured and disposed to clean bottles with a cleaning fluid; said rotatable bottle cleaning station comprising a first bottle cleaning station ring-shaped disk structure configured to hold the tops of bottles; said first bottle cleaning station ring-shaped structure comprising a plurality of interchangeable receptacles to hold the tops of bottles in said bottle cleaning station; said rotatable cleaning station comprising: a first bottle cleaning station chamber being configured and disposed to confine the top of each bottle being processed and also being configured to dispose the lower portion of each bottle, having its top confined, outside said first bottle cleaning station chamber; a first bottle cleaning station arrangement being configured and disposed to provide a disinfecting environment in said first bottle cleaning station chamber to disinfect solely the tops of the bottles being processed; and the top of each bottle including the mouth portion and at least a portion of the neck portion of each bottle being processed; a first bottle cleaning station conveyer arrangement being configured and disposed to move bottles into said rotatable bottle cleaning station; said first bottle cleaning station conveyer arrangement for moving bottles into said rotatable bottle cleaning station comprising: a second bottle cleaning station ring-shaped disk structure configured to hold the tops of bottles; said second bottle cleaning station ring-shaped structure comprising a plurality of interchangeable receptacles to hold the tops of bottles in said second bottle cleaning station conveyer arrangement; a second bottle cleaning station chamber being configured and disposed to confine the top of each bottle being processed and also being configured to dispose the lower portion of each bottle, having its top confined, outside said second bottle cleaning station chamber; a second bottle cleaning station arrangement being configured and disposed to provide a disinfecting environment in said second bottle cleaning station chamber to disinfect solely the tops of the bottles being processed; said beverage bottling plant for filling bottles with a liquid beverage filling material further comprising: a closing station being configured and disposed to secure bottle caps to bottles to be closed; said bottle closing station comprising a rotatable structure; said bottle closing station rotatable structure comprising a first bottle closing station ring-shaped disk structure configured to hold the tops of bottles; said first bottle closing station ring-shaped structure comprising a plurality of interchangeable receptacles to hold the tops of bottles in said bottle closing station; said bottle closing station further comprising: a first bottle closing station chamber being configured and disposed to confine the top of each bottle being processed and also being configured to dispose the lower portion of each bottle, having its top confined, outside said first bottle closing station chamber; and a first bottle closing station arrangement being configured and disposed to provide an anaerobic environment in said first bottle closing station chamber to anaerobically contain solely the tops of the bottles being processed; a first bottle closing station conveyer arrangement being configured and disposed to move filled bottles from said rotatable beverage filling machine into said rotatable closing station; said first bottle closing station conveyer arrangement for moving filled bottles from said rotatable beverage filling machine into said rotatable bottle closing station comprising: a second bottle closing station ring-shaped disk structure configured to hold the tops of bottles; said second bottle closing station ring-shaped disk structure comprising a plurality of interchangeable receptacles to hold the tops of bottles in said conveyer arrangement; a second bottle closing station chamber being configured and disposed to confine the top of each bottle being processed and also being configured to dispose the lower portion of each bottle, having its top confined, outside said second bottle closing station chamber; said beverage bottling plant further comprising: a second bottle closing station conveyer arrangement being configured and disposed to move bottles from said rotatable bottle closing station and into a packaging station; said second bottle closing station conveyer arrangement for moving bottles from said rotatable bottle closing station and into a packaging station comprising: a third bottle closing station ring-shaped disk structure configured to hold the tops of bottles; said third bottle closing station ring-shaped disk structure comprising a plurality of interchangeable receptacles to hold the tops of bottles in said second bottle closing station conveyer arrangement; and a third bottle closing station chamber being configured and disposed to confine the top of each bottle being processed and also being configured to dispose the lower portion of each bottle, having its top confined, outside said third bottle closing station chamber; and said beverage bottling plant further comprising: a packaging station being configured to package a plurality of bottles into single containers.

Another feature or aspect of an embodiment is believed at the time of the filing of this patent application to possibly reside broadly in a container handling machine for containers such as bottles etc. with a carousel that rotates around a vertical axis, with handling stations located at appropriate intervals for the handling of the containers, whereby the handling stations are located in a space that is essentially enclosed and is pressurized with a controlled atmosphere and consists of rotating portions of the space and non-rotating portions that are stationary with respect to the rotating portions, with receptacles (12) for holding the containers corresponding to each handling station, characterized by the fact that these receptacles (12) are interchangeable.

Another feature or aspect of an embodiment is believed at the time of the filing of this patent application to possibly reside broadly in a container handling machine, characterized by the fact that each receptacle (12) is geometrically adapted to one type of container and/or to a group of different types of containers.

Yet another feature or aspect of an embodiment is believed at the time of the filing of this patent application to possibly reside broadly in Container handling machine, characterized by the fact that the receptacles (12) are not interchangeable and can be adapted by interchangeable inserts to a type of container and/or to a group of different types of containers.

Still another feature or aspect of an embodiment is believed at the time of the filing of this patent application to possibly reside broadly in a container handling machine, characterized by the fact that the non-interchangeable receptacles (12) are adapted geometrically to the type of container with the container neck diameter and/or the container head diameter.

A further feature or aspect of an embodiment is believed at the time of the filing of this patent application to possibly reside broadly in a container handling machine, characterized by the fact that the device to hold the receptacles (12) can rotate or pivot.

Another feature or aspect of an embodiment is believed at the time of the filing of this patent application to possibly reside broadly in a container handling machine, characterized by the fact that the device to hold the receptacles (12) cannot rotate or pivot.

Yet another feature or aspect of an embodiment is believed at the time of the filing of this patent application to possibly reside broadly in a container handling machine, characterized by the fact that the receptacles (12) and/or the inserts surround the neck rings of containers provided with neck rings both on their upper edge and on their lower edge, at least partly.

Still another feature or aspect of an embodiment is believed at the time of the filing of this patent application to possibly reside broadly in a container handling machine, characterized by the fact that the receptacles (12) and/or the inserts are adapted to the contour of the bottom edge of the capping area of containers that do not have a neck ring.

The components disclosed in the various publications, disclosed or incorporated by reference herein, may possibly be used in possible embodiments of the present invention, as well as equivalents thereof.

The appended drawings in their entirety, including all dimensions, proportions and/or shapes in at least one embodiment of the invention, are accurate and are hereby included by reference into this specification.

Some examples of bottling systems that may possibly be utilized or possibly adapted for use in at least one possible embodiment of the present application may possibly be found in the following U.S. patents, all assigned to the Assignee herein, namely: U.S. Pat. No. 4,911,285; No. 4,944,830; No. 4,950,350; No. 4,976,803; No. 4,981,547; No. 5,004,518; No. 5,017,261; No. 5,062,917; No. 5,062,918; No. 5,075,123; No. 5,078,826; No. 5,087,317; No. 5,110,402; No. 5,129,984; No. 5,167,755; No. 5,174,851; No. 5,185,053; No. 5,217,538; No. 5,227,005; No. 5,413,153; No. 5,558,138; No. 5,634,500; No. 5,713,403; No. 6,276,113; No. 6,213,169; No. 6,189,578; No. 6,192,946; No. 6,374,575; No. 6,365,054; No. 6,619,016; No. 6,474,368; No. 6,494,238; No. 6,470,922; and No. 6,463,964.

All, or substantially all, of the components and methods of the various embodiments may be used with at least one embodiment or all of the embodiments, if more than one embodiment is described herein.

Some examples of stepping motors that may possibly be utilized or possibly adapted for use in at least one possible embodiment of the present application may possibly be found in the following U.S. patents: U.S. Pat. No. 6,348,774 issued to Andersen et al. on Feb. 19, 2002; U.S. Pat. No. 6,373,209 issued to Gerber et al. on Apr. 16, 2002; U.S. Pat. No. 6,424,061 issued to Fukuda et al. on Jul. 23, 2002; U.S. Pat. No. 6,509,663 issued to Aoun on Jan. 21, 2003; U.S. Pat. No. 6,548,923 to Ohnishi et al. on Apr. 15, 2003; and U.S. Pat. No. 6,661,193 issued to Tsai on Dec. 9, 2003.

All of the patents, patent applications and publications recited herein, and in the Declaration attached hereto, are hereby incorporated by reference as if set forth in their entirety herein.

Some examples of sensors that may possibly be utilized or possibly adapted for use in at least one possible embodiment of the present application may possibly be found in the following U.S. Patents: U.S. Pat. No. 6,062,248 issued to Boelkins on May 16, 2000; U.S. Pat. No. 6,223,593 issued to Kubisiak et al. on May 1, 2001; U.S. Pat. No. 6,466,035 issued to Nyfors et al. on Oct. 15, 2002; U.S. Pat. No. 6,584,851 issued to Yamagishi et al. on Jul. 1, 2003; U.S. Pat. No. 6,631,638 issued to James et al. on Oct. 14, 2003; and U.S. Pat. No. 6,707,307 issued to McFarlane et al. on Mar. 16, 2004.

It will be understood that the examples of patents, published patent applications, and other documents which are included in this application and which are referred to in paragraphs which state "Some examples of . . . which may possibly be used in at least one possible embodiment of the present application. . ." may possibly not be used or useable in any one or more embodiments of the application.

The sentence immediately above relates to patents, published patent applications and other documents either incorporated by reference or not incorporated by reference.

Some examples of servo-motors that may possibly be utilized or possibly adapted for use in at least one possible embodiment of the present application may possibly be found in the following U.S. patents: U.S. Pat. No. 4,050,434 issued to Zbikowski et al. on Sep. 27, 1977; U.S. Pat. No. 4,365,538 issued to Andoh on Dec. 28, 1982; U.S. Pat. No. 4,550,626 issued to Brouter on Nov. 5, 1985; U.S. Pat. No. 4,760,699 issued to Jacobsen et al. on Aug. 2, 1988; U.S. Pat. No. 5,076,568 issued to de Jong et al. on Dec. 31, 1991; and U.S. Pat. No. 6,025,684 issued to Yasui on Feb. 15, 2000.

Some examples of labeling machines which may possibly be utilized in at least one possible embodiment may possibly be found in the following U.S. patents: U.S. Pat. No. 6,634,400, entitled "Labeling machine;" U.S. Pat. No. 6,561,246, entitled "Labeling machine capable of precise attachment of a label to different sizes of containers;" U.S. Pat. No. 6,550,512, entitled "Labeling machine capable of preventing erroneous attachment of labels on containers;" U.S. Pat. No. 6,543,514, entitled "In-line continuous feed sleeve labeling machine and method;" U.S. Pat. No. 6,378,587, entitled "Cylindrical container labeling machine;" U.S. Pat. No. 6,328,086, entitled "Labeling machine;" U.S. Pat. No. 6,315,021, entitled "Labeling machine;" U.S. Pat. No. 6,263,940, entitled "In-line continuous feed sleeve labeling machine and method;" U.S. Pat. No. 6,199,614, entitled "High speed labeling machine having a constant tension driving system;" U.S. Pat. No. 6,167,935, entitled "Labeling machine; U.S. Pat. No. 6,066,223, entitled "Labeling machine and method; U.S. Pat. No. 6,050,319, entitled "Non-round container labeling machine and method;" and U.S. Pat. No. 6,045,616, entitled "Adhesive station and labeling machine."

The corresponding foreign and international patent publication applications, namely, Federal Republic of Germany Patent Application No. 103 42 415.6, filed on Sep. 12, 2003, having inventor Volker Till, and DE-OS 103 42 415.6 and DE-PS 103 42 415.6, as well as their published equivalents, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

In the event that automatic tool changes would be desirable in a possible embodiment, some examples of automatic tool changer apparatuses which may possibly be utilized or adapted for use in at least one possible embodiment may possibly be found in the following U.S. Patents: U.S. Pat. No. 5,300,006, entitled "Automatic tool changer;" U.S. Pat. No. 4,835,838, entitled "Automatic tool changer in machine tool;" U.S. Pat. No. 4,799,308, entitled "Automatic tool changer;" U.S. Pat. No. 4,773,152, entitled "Automatic tool changer;" U.S. Pat. No. 4,764,064, entitled "Tool changer;" U.S. Pat. No. 4,696,091, entitled "Automatic tool changer;" U.S. Pat. No. 4,614,137, entitled "Magnetic tool changer;" U.S. Pat. No. 4,610,074, entitled "Automatic tool changer of a machine tool;" U.S. Pat. No. 4,601,094, entitled "Turning machine with an automatic tool changer;" U.S. Pat. No. 4,499,650, entitled "Automatic tool changer;" U.S. Pat. No. 4,467,517, entitled "Tool changer for facing head;" U.S. Pat. No. 4,387,502, entitled "Semi-automatic tool changer;" and U.S. Pat. No. 4,329,770, entitled "Automatic tool changer."

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

Some examples of bottling systems which may possibly be utilized or adapted for use in at least one possible embodiment may possibly be found in the following U.S. patents: U.S. Pat. No. 6,684,602, entitled "Compact bottling machine;" U.S. Pat. No. 6,470,922, entitled "Bottling plant for bottling carbonated beverages;" U.S. Pat. No. 6,390,150, entitled "Drive for bottling machine;" U.S. Pat. No. 6,374,575, entitled "Bottling plant and method of operating a bottling plant;" U.S. Pat. No. 6,192,946, entitled "Bottling system;" U.S. Pat. No. 6,185,910, entitled "Method and an apparatus for high-purity bottling of beverages;" U.S. Pat. No. 6,058,985, entitled "Bottling machine with a set-up table and a set-up table for a bottling machine and a set-up table for a bottle handling machine;" U.S. Pat. No. 5,996,322, entitled "In-line bottling plant;" U.S. Pat. No. 5,896,899, entitled "Method and an apparatus for sterile bottling of beverages;" U.S. Pat. No. 5,848,515, entitled "Continuous-cycle sterile bottling plant;" U.S. Pat. No. 5,634,500, entitled "Method for bottling a liquid in bottles or similar containers;" and U.S. Pat. No. 5,425,402, entitled "Bottling system with mass filling and capping arrays."

Federal Republic of Germany Patent Application No. 103 40 365.5, filed on Sep. 2, 2003, having inventor Dieter-Rudolf KRULITSCH, and its U.S. equivalent, U.S. patent application Ser. No. 10/931,817, filed Sep. 1, 2004, show a device for the exchange of handling components, such as, support devices, centering devices, holding devices and neck/collar support devices, and the like, as well as flushing or rinsing containers, or flushing or rinsing conduits, and flushing or rinsing nozzles. The device is designed such that the exchange can be carried out automatically with a single exchange procedure by or, respectively, at all handling heads of such a container handling machine. Further, the applications teach that the exchange of handling components can be done while inside an aseptic bottling system or clean room. Federal Republic of Germany Patent Application No. 103 40 365.5, and its U.S. equivalent, U.S. patent application Ser. No. 10/931,817, filed Sep. 1, 2004, are hereby incorporated by reference as if set forth in their entirety herein.

Some examples of starwheels which may possibly be utilized or adapted for use in at least one possible embodiment may possibly be found in the following U.S. Patents: U.S. Pat. No. 5,613,593, entitled "Container handling starwheel;" U.S. Pat. No. 5,029,695, entitled "Improved starwheel;" U.S. Pat. No. 4,124,112, entitled "Odd-shaped container indexing starwheel;" and U.S. Pat. No. 4,084,686, entitled "Starwheel control in a system for conveying containers."

Some examples of centering devices for bottle handling devices which may possibly be utilized or adapted for use in at least one possible embodiment may possibly be found in Federal Republic of Germany Application No. DE P 103 14 634, entitled "Spülbares Huborgan" having inventor Herbert Bernhard, and its U.S. equivalent, having Ser. No. 10/813,657, entitled "A beverage bottling plant for filling bottles with a liquid beverage filling material, and an easily cleaned lifting device in a beverage bottling plant" and filed on Mar. 30, 2004; Federal Republic of Germany Application No. DE P 103 08 156, entitled "Huborgan zum Anpressen von Gefässen an Gefässfüillmaschinen" having inventor Herbert Bernhard, and its U.S. equivalent, Ser. No. 10/786,256, entitled "A beverage bottling plant for filling bottles with a liquid beverage filling material, and a container filling lifting device for pressing containers to container filling machines", filed on Feb. 25, 2004; and Federal Republic of Germany Application No. P 103 26 618.6, filed on Jun. 13, 2003, having inventor Volker TILL, and its U.S. equivalent, Ser. No. 10/865,240, filed on Jun. 10, 2004 . The above applications are hereby incorporated by reference as if set forth in their entirety herein.

AT LEAST PARTIAL LIST OR REFERENCE NUMBERS

1 Filling machine, filler
2 Bottles
3 Rotor
4 Filing element
5 Dividing screw
6 Input star conveyer, star wheel conveyer
7 Transfer star conveyer, star wheel conveyer
8 Closer, closing station, closing machine
9 Exit star wheel conveyer, star wheel conveyer
10 Transport conveyer for filled, closed bottles
11 Guide element for 6
12 Guide element for 7
13 Guide element for 9
14 Annular vessel
15 Housing
16 Channel for liquid in 15
17 Exit opening, filling opening, lower portion
18 Large neck support
19 Neck
20 Flushing conduit, flushing nozzle
21 Ring structure
24 Sterile compartment
25 Stationary ring structure
100 Beverage bottling plant
101 Rinser, rinser station—change to 3
103 Conveyer to feed bottles to rinser
104 Conveyer to pass bottles to filling machine
104*a* Star wheel
105 Beverage filling machine
105' Rotor
106 Closer, closer station
107 Conveyer to pass containers to labeling station
108 Labeling station, labeling device
108*a* Labeling module for first product
108*b* Labeling module for second product
108*c* Inspecting station or module
109 Conveyer to output first product containers
110 Conveyer arrangement to output second product containers
111 Conveyer arrangement to output incorrectly labeled containers
112 Central control unit, controller
113 Filling positions
113*a* Container carriers/bottle carriers
114 Filling device, element, apparatus
117 Toroidal vessel
121 Conduit for first product
122 Conduit for second product
123 First product mixer
124 Second product mixer
A Direction of travel of bottles
B Bottles

What is claimed is:

1. A container handling machine for handling containers, said container handling machine comprising:

a rotatable carousel being configured and disposed to rotate about a vertical axis;

a stationary structure being disposed adjacent to and about a substantial portion of said carousel;

said rotatable carousel and said stationary structure being configured and disposed to together form a ring-shaped chamber;

a pressurizing device being configured and disposed to pressurize said chamber with a pressurizing gas;

a plurality of container handling structures being disposed on and about the periphery of said carousel;

said container handling structures comprising interchangeable receptacles being configured to receive and hold containers;

said container handling structures comprising recess structures to receive and hold said interchangeable receptacles;

said interchangeable receptacles comprising at least a first type of interchangeable receptacles and a second type of interchangeable receptacles, wherein said first type of interchangeable receptacles are configured to receive a first type of containers and said second type of interchangeable receptacles are configured to receive a second type of containers;

said interchangeable receptacles being interchangeable to permit handling of different types of containers by said container handling machine;

said interchangeable receptacles being disposed to hold the top portion of containers in said chamber to minimize contamination of the contents of the containers during handling by said container handling machine; and said recess structures being pivotable to permit pivoting movement of said interchangeable receptacles.

2. The container handling machine according to claim 1, wherein said receptacles are configured to be adapted geometrically to receive at least one of: one type of container, and a group of different types of containers.

3. The container handling machine according to claim 2, wherein at least one of (C) and (D):

(C) at least a portion of said receptacles are configured to at least partly surround neck rings of containers provided with neck rings, both on an upper edge and on a lower edge of the neck rings; and (D) at least a portion of said receptacles are configured to match a contour of a bottom edge of a capping area of containers that do not have a neck ring.

4. The container handling machine according to claim 1, wherein at least one of (C) and (D):

(C) at least a portion of said receptacles are configured to at least partly surround neck rings of containers provided with neck rings, both on an upper edge and on a lower edge of the neck rings; and (D) at least a portion of said receptacles are configured to match a contour of a bottom edge of a capping area of containers that do not have a neck ring.

5. A container handling machine for handling containers, said container handling machine comprising:

a rotatable carousel being configured and disposed to rotate about a vertical axis;

a stationary structure being disposed adjacent to and about a substantial portion of said carousel;

said rotatable carousel and said stationary structure being configured and disposed to together form a ring-shaped chamber;

a pressurizing device being configured and disposed to pressurize said chamber with a pressurizing gas;

a plurality of container handling structures being disposed on and about the periphery of said carousel;

said container handling structures comprising receptacles being configured to receive and hold containers;

said receptacles being disposed to hold the top portion of containers in said chamber to minimize contamination of the contents of the containers during handling by said container handling machine;

a plurality of interchangeable receptacle inserts being configured to be inserted into said receptacles to modify the receptacles to permit handling of different types of containers by said container handling machine;

said container handling structures comprising recess structures to which said receptacles are connected; and said recess structures being pivotable to permit pivoting movement of said receptacles.

6. The container handling machine according to claim 5, wherein said receptacles are configured to be modified by said receptacle inserts to receive at least one of: one type of container, and a group of different types of containers.

7. The container handling machine according to claim 6, wherein said receptacles are configured to be modified by said receptacle inserts to receive the type of container according to at least one of: the container neck diameter, and the container head diameter.

8. The container handling machine according to claim 7, wherein at least one of (C) and (D):

(C) at least a portion of said receptacles are configured to at least partly surround neck rings of containers provided with neck rings, both on an upper edge and on a lower edge of the neck rings; and (D) at least a portion of said receptacles are configured to match a contour of a bottom edge of a capping area of containers that do not have a neck ring.

9. The container handling machine according to claim 6, wherein at least one of (C) and (D):

(C) at least a portion of said receptacles are configured to at least partly surround neck rings of containers provided with neck rings, both on an upper edge and on a lower edge of the neck rings; and (D) at least a portion of said receptacles are configured to match a contour of a bottom edge of a capping area of containers that do not have a neck ring.

10. The container handling machine according to claim 5, wherein at least one of (C) and (D):

(C) at least a portion of said receptacles are configured to at least partly surround neck rings of containers provided with neck rings, both on an upper edge and on a lower edge of the neck rings; and (D) at least a portion of said receptacles are configured to match a contour of a bottom edge of a capping area of containers that do not have a neck ring.

11. A container handling machine for handling containers, said container handling machine comprising:

a rotatable carousel being configured and disposed to rotate about a vertical axis;

a stationary structure being disposed adjacent to and about a substantial portion of said carousel;

said rotatable carousel and said stationary structure being configured and disposed to together form a ring-shaped chamber;

said chamber being configured and disposed to substantially enclose solely the top portions of containers;

a pressurizing device being configured and disposed to pressurize said chamber with a pressurizing gas;

a plurality of container handling structures being disposed on and about the periphery of said carousel;

said container handling structures comprising receptacles being configured to receive and hold containers;

said receptacles being disposed to hold the top portion of containers in said chamber to minimize contamination of the contents of the containers during handling by said container handling machine; and a plurality of interchangeable receptacle inserts being configured to be inserted into said receptacles to modify the receptacles to permit handling of different types of containers by said container handling machine.

12. The container handling machine according to claim 11, wherein said receptacles are configured to be modified by said receptacle inserts to receive at least one of: one type of container, and a group of different types of containers.

13. The container handling machine according to claim 12, wherein said receptacles are configured to be modified by said receptacle inserts to receive the type of container according to at least one of: the container neck diameter, and the container head diameter.

14. The container handling machine according to claim 13, wherein:

said container handling structures comprise recess structures to which said receptacles are connected; and said recess structures are one of (A) and (B):

(A) at least one of: rotatable and pivotable; and (B) fixed and stationary.

15. The container handling machine according to claim 14, wherein at least one of (C) and (D):

(C) at least a portion of said receptacles are configured to at least partly surround neck rings of containers provided with neck rings, both on an upper edge and on a lower edge of the neck rings; and (D) at least a portion of said receptacles are configured to match a contour of a bottom edge of a capping area of containers that do not have a neck ring.

16. The container handling machine according to claim 11, wherein:

said container handling structures comprise recess structures to which said receptacles are connected; and said recess structures are pivotable.

17. The container handling machine according to claim 16, wherein said receptacles are configured to be modified by said receptacle inserts to receive at least one of: one type of container, and a group of different types of containers.

18. The container handling machine according to claim 17, wherein:

said receptacles are configured to be modified by said receptacle inserts to receive the type of container according to at least one of: the container neck diameter, and the container head diameter; and at least one of (C) and (D):

(C) at least a portion of said receptacles are configured to at least partly surround neck rings of containers provided with neck rings, both on an upper edge and on a lower edge of the neck rings; and (D) at least a portion of said receptacles are configured to match a contour of a bottom edge of a capping area of containers that do not have a neck ring.

19. The container handling machine according to claim 11, wherein:

said container handling structures comprise recess structures to which said receptacles are connected; and said recess structures are fixed and stationary.

20. The container handling machine according to claim 19, wherein:

said receptacles are configured to be modified by said receptacle inserts to receive at least one of: one type of container, and a group of different types of containers;

said receptacles are configured to be modified by said receptacle inserts to receive the type of container according to at least one of: the container neck diameter, and the container head diameter; and at least one of (C) and (D):

(C) at least a portion of said receptacles are configured to at least partly surround neck rings of containers provided with neck rings, both on an upper edge and on a lower edge of the neck rings; and (D) at least a portion of said receptacles are configured to match a contour of a bottom edge of a capping area of containers that do not have a neck ring.

* * * * *